US006596150B2

(12) United States Patent
Nishino et al.

(10) Patent No.: US 6,596,150 B2
(45) Date of Patent: Jul. 22, 2003

(54) PRODUCTION METHOD FOR AN ALUMINUM SUPPORT FOR A LITHOGRAPHIC PRINTING PLATE

(75) Inventors: Atsuo Nishino, Shizuoka (JP); Yoshitaka Masuda, Shizuoka (JP); Hirokazu Sawada, Shizuoka (JP); Akio Uesugi, Shizuoka (JP); Masahiro Endo, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/320,445

(22) Filed: May 27, 1999

(65) Prior Publication Data

US 2002/0153253 A1 Oct. 24, 2002

(30) Foreign Application Priority Data

May 28, 1998 (JP) ..... 10-147690
Aug. 3, 1998 (JP) ..... 10-219303
Dec. 24, 1998 (JP) ..... 10-367618

(51) Int. Cl.[7] ..... B01N 3/03; B01N 3/04

(52) U.S. Cl. ..... 205/153; 205/139; 205/213; 205/214; 205/220; 205/325; 205/658; 205/660; 205/661; 205/674; 205/685; 216/52; 216/102; 216/103; 451/54; 451/55; 451/57; 451/59

(58) Field of Search ..... 205/647, 660, 205/661, 662, 139, 153, 213, 214, 220, 223, 325, 658, 921, 674, 685; 451/54, 55, 57, 59, 36, 37; 216/52, 102, 103

(56) References Cited

U.S. PATENT DOCUMENTS 4,183,788 A * 1/1980 Fromson et al. ..... 430/278
4,269,677 A * 5/1981 Blomsterberg ..... 205/646
4,427,760 A * 1/1984 Nagazawa et al. ..... 430/287
5,284,735 A * 2/1994 Okamoto ..... 430/281
5,567,300 A * 10/1996 Datta et al. ..... 205/652
5,651,871 A 7/1997 Fromson et al.
5,832,834 A * 11/1998 Nishino et al. ..... 101/459
6,143,158 A * 11/2000 Nishino et al. ..... 205/219

FOREIGN PATENT DOCUMENTS

EP 0 573 988 A2 12/1993
EP 0835764 A1 4/1998
EP 0 835 764 A1 4/1998
EP 0874068 A1 10/1998
EP 0 874 068 A1 10/1998
EP 0 924 101 A2 * 6/1999
JP 11-170721 * 12/1997

OTHER PUBLICATIONS

JP 09277735 A (Abstract) Oct. 1997.
JP 08252989 A (Abstract), Oct. 1996.
JP 10183400 A (Abstract) Jul. 1998.
JP 07009777 A (Abstract) Jan. 1995.
Partial European Search Report Oct. 1999.
European Search Report Jan. 2000.

* cited by examiner

*Primary Examiner*—Roy King
*Assistant Examiner*—William T. Leader
(74) *Attorney, Agent, or Firm*—Sughrue Mion, PLLC

(57) ABSTRACT

Disclosed is a production method of an aluminum support for a lithographic printing plate, capable of stable and low-cost production of an aluminum support for a lithographic printing plate, the support being scarcely subject to generation of treatment unevenness called streaks or grainy unevenness ascribable to the different in the aluminum dissolving rate due to the difference in the orientation of the crystal grain. The aluminum support is produced by surface graining and then polishing an aluminum plate or by polishing an aluminum plate while etching it in an aqueous acid or alkali solution. The aluminum plate may be subjected to polishing and then to anodization or may be subjected to polishing, to surface graining, again to or not to polishing and then to anodization. A production method for producing a high-quality support for a lithographic printing plate, free of local unevenness is also disclosed.

21 Claims, 5 Drawing Sheets

PRODUCTION METHOD FOR AN ALUMINUM SUPPORT FOR A LITHOGRAPHIC PRINTING PLATE

FIELD OF THE INVENTION

The present application is based on Japanese Application Nos. Hei. 10-147690, Hei. 10-219303 and Hei. 10-367618, which are incorporated herein by reference.

The present invention relates to a support for a lithographic printing plate, a production method thereof and a polishing method of an aluminum plate. More specifically, the present invention relates to an aluminum support for a lithographic printing plate, in which the surface of the aluminum support is uniformly roughened, so that when a lithographic printing image is formed on the surface, good suitability for plate inspection is attained, high printing durability is obtained due to good adhesion between the aluminum support and the photosensitive layer, good water receptivity is assured, and the amount of fountain solution on the plate surface at the printing can be easily viewed.

BACKGROUND OF THE INVENTION

In the field of lithographic printing plates, it is well known to produce a lithographic printing plate by coating a positive or negative photosensitive composition on the surface of an aluminum support and then subjecting the composition to drying, exposing by a chemical radioactive ray and developing.

In general, the aluminum plate is necessary to pass through several treatments before it is actually used as a support of a lithographic printing plate. For example, the aluminum plate is treated by a combination of one or more of mechanical surface graining, chemical etching, electrochemical surface graining and the like to impart water receptivity and adhesion to the photosensitive layer. The aluminum surface not subjected to anodization is fairly soft and easily abraded, therefore, the surface is usually anodized to form an oxide coating thereon. The thus-treated aluminum plate has a hard surface and is favored with excellent abrasion resistance, high affinity for water, good holding property and strong adhesion to the photosensitive layer. Thereafter, the surface is generally sealed with a composition for imparting water wettability and then a photosensitive composition is coated thereon.

As the surface graining method of an aluminum support for a lithographic printing plate, AC etching is commonly used, where the current used is a special alternating waveform current such as normal sinusoidal current and rectangular wave, and an AC current is passed using an appropriate electrode such as graphite as a counter electrode to thereby roughen the surface of an aluminum plate. The treatment is usually performed once but the pit depth obtained is shallow all over and the plate has poor printing durability. To cope with this, a number of methods have been proposed with an attempt to obtain an aluminum plate suitable as a support for printing plate, which is grained such that pits having a depth larger than the diameter are uniformly and densely present. For example, a surface graining method using a special electrolysis power source waveform (see, JP-A-53-67507 (the term "JP-A" as used herein means an "unexamined published Japanese patent application")) and methods characterized by the ratio in the quantity of electricity between anode time and cathode time at the electrolysis surface graining using alternating current (see, JP-A-54-65607), the power source waveform (see, JP-A-56-25381) or the combination of the quantities of electricity passed per unit area (see, JP-A-56-29699) are known.

On the other hand, an aluminum support is produced by such a method that an aluminum ingot is dissolved and held to produce a slab (thickness: from 400 to 600 nm, width: from 1,000 to 2,000 mm, length: from 2,000 to 6,000 mm) and the slab is passed through a scalping step of cutting the impurity structure part on the slab surface by a scalping machine at every 3 to 10 mm and then a soaking treatment step of holding the slab in a soaking pit at from 480 to 540° C. for from 6 to 12 hours for removing the stress inside the slab and uniformalizing the structure. Thereafter, the aluminum plate is rolled by hot rolling at from 480 to 540° C. into a thickness of from 5 to 40 mm, cold rolled at room temperature into a predetermined thickness, annealed for uniformalizing the structure to homogenize the rolled structure and the like, cold rolled into a prescribed thickness, and then remedied to obtain a sheet having good flatness. The thus-prepared aluminum support is used as a support for a lithographic printing plate.

In view of energy savings or effective use of resources, it is demanded to use a general-purpose aluminum plate or an aluminum plate produced by omitting the intermediate annealing or soaking from the production process of the aluminum plate, as the aluminum support for a lithographic printing plate.

However, if an aluminum support for a lithographic printing plate is manufactured from such an aluminum plate, treatment unevenness called streaks or grainy unevenness is readily generated. This is considered to occur because the chemical dissolution reaction of aluminum proceeds at a different rate depending on the crystal orientation and in turn the electrochemical pitting reaction of aluminum proceeds differently depending on the crystal orientation.

In other words, irregularities generated due to the difference in the dissolution rate at the chemical dissolution reaction appear as streaks or grainy unevenness or the difference in the pitting reaction depending on the crystal orientation (difference in the pit number or size) appear as streaks or grainy unevenness.

In order to improve the retardation to scumming at the printing when a printing plate is manufactured, it is well known to perform chemical etching after the surface graining. When the plate is used as a PS plate for proof printing, disinclination for catching of a sponge supplying fountain solution is one of important printing capabilities. When the sponge is difficult to catch, debris of the sponge is scarcely generated and the printing plate is not prone to scumming. The increase in the etching amount after the surface graining is accompanied with the following advantage and disadvantage.

When the amount of chemical etching is increased, the printed matter is difficultly soiled, however, due to the difference in the aluminum dissolving rate ascribable to the crystal orientation of aluminum, streaks or grainy unevenness become outstanding. Furthermore, adhesion between the photosensitive layer and the aluminum support is deteriorated to reduce the printing durability.

In general, an aluminum support for a lithographic printing plate is subjected to anodization after the surface graining to have white appearance which is considered preferable, so that when a lithographic printing image is formed thereon, good visual contrast can be attained between the image area and the non-image area and the evaluation of the image quality by a printer can be facilitated. To this effect, the aluminum plate is demanded to have a white surface so as to obtain good image contrast and at the same time to ensure an image adhesion on the surface of the sheet subjected to surface graining and anodization and also have a surface hardness.

On the other hand, in general, an aluminum plate used as a lithographic printing plate support is required to have appropriate adhesion to the photosensitive material and appropriate water receptivity and also must be uniformly surface grained. The term "uniformly surface grained" as used herein means that pits produced are appropriately uniform in the size and such pits are produced uniformly throughout the surface. The pit has an outstanding effect also on the printing performance of the printing material, such as disinclination for scumming and printing durability, and the pit quality is an important factor in the production of a printing material. In recent years, it is a problem to be solved to continuously and stably produce good quality pits.

JP-A-6-92052 (the term "JP-A" as used herein means an "unexamined published Japanese patent application") has proposed a patent constituted by a step of mechanical surface graining, a step of etching of from 0.5 to 30 g/m$^2$ and a step of pulse passing of from 200 to 600 c/dm$^2$. JP-A-7-9776 has proposed to perform mechanical surface graining, etching of from 1 to 5 g/m$^2$ and then electrochemical surface graining with a quantity of alternating current (AC) electricity of from 300 to 800 c/dm$^2$. Also, a patent constituted by mechanical surface graining, etching of from 0.5 to 30 g/m$^2$ and ac electrolysis of from 200 to 600 c/dm$^2$ has been proposed. The surface graining of the support surface includes mechanical surface graining, chemical surface graining and electrochemical surface graining. In this concern, JP-A-6-24166 discloses a patent where various conditions for the mechanical surface graining, chemical etching and electrochemical surface graining are varied, more specifically, after the mechanical surface graining, chemical etching of from 0.5 to 30 g/m$^2$ is performed, electrochemical surface graining is applied at an appropriate current density with an appropriate quantity of electricity, etching of from 0.1 to 10 g/m$^2$ is performed to finish smooth angles, and then anodization is applied.

However, as a requirement from clients in recent years, a high-quality printing plate more freed from local unevenness is demanded. Therefore, a lithographic printing plate support capable of satisfying such a requirement is demanded and at the same time, the production cost must be minimized. According to the techniques disclosed in JP-A-692052 and JP-A-6-24166, preliminary polishing is omitted, accordingly, when an original AL having local recessions is subjected to mechanical surface graining, chemical etching and electrochemical surface graining, the recession part fails in attaining uniform chemical etching or electrochemical surface graining and troubles are generated in that portion, such as reduction in the printing durability or deterioration in the disinclination for catching up of ink on the recession.

Under these circumstances, the present invention has been made. Accordingly, the object of the present invention is to provide a method for producing a high-quality lithographic printing plate support free of local unevenness.

SUMMARY OF THE INVENTION

As a result of extensive investigations, the present inventors have found that when an aluminum plate is subjected to polishing after the surface graining, the Projected portion is roundly shaved and the disinclination for catching of a sponge and in turn the scumming reduction can be improved.

Furthermore, the present inventors have found a production method of an aluminum support for a lithographic printing plate, such that by subjecting an aluminum plate treated to have fine irregularities to electrochemical surface graining in an acidic aqueous solution and then to polishing, an aluminum support prevented from generation of troubles called streaks or grainy unevenness ascribable to the aluminum crystal orientation and not prone to scumming can be obtained.

When fine irregularities are imparted to an aluminum plate, the fine irregularities cause irregular reflection and thereby the streak or grainy unevenness becomes difficult to recognize. Moreover, the presence of fine irregularities have an effect that honeycomb pits of from 0.1 to 3 $\mu$m are thereafter uniformly produced in an aqueous nitric acid solution independent of the crystal orientation, as a result, the streak or grainy unevenness becomes difficult to appear.

Further, the above-described object of the present invention can be attained by a production method of a lithographic printing plate support, which comprises subjecting a lithographic printing plate support to surface graining or etching by mechanical surface graining, chemical etching or electrochemical surface graining, and then shaving tips of irregularities, particularly projections on the surface of the lithographic printing plate support by filiform fibers having a diameter of from 5 to 600 $\mu$M.

In order to solve the problems in conventional techniques, to obtain uniform quality and also to minimize the production cost, an invention descried below has been created. That is, in a method for producing a lithographic printing plate support, surface graining or etching is performed by mechanical surface graining, chemical etching or electrochemical surface graining, and tips of irregularities, particularly projections are shaved by macro filiform fibers having a diameter of from 5 to 500 $\mu$m. Preferably, the fibers are formed into a roller having a hardness of 60° or less and tips of irregularities, particularly projections on the roughened or etched surface of the lithographic printing plate support are shaved by the roller. As a result, a high-quality lithographic printing plate support free of local unevenness can be produced in the present invention.

BRIEF DESCRIPTION OF DRAWINGS

In the accompanying drawings.

DETAILED DESCRIPTION OF THE INVENTION

Figure 1:
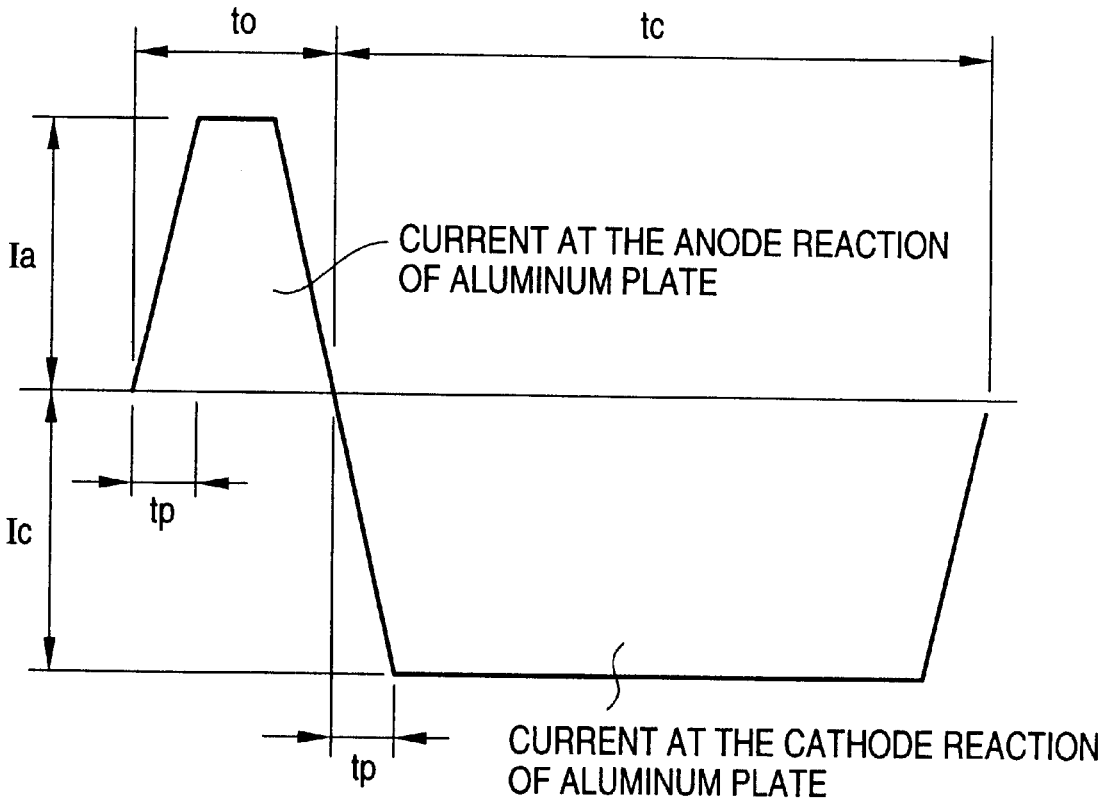
FIG. 1 is a wave profile showing one example of a trapezoidal wave AC current power waveform preferably used in the electrochemical surface graining of the present invention.

The present invention can be achieved by surface graining and then polishing an aluminum plate or by alternately performing the surface graining and the polishing. The practical embodiment of the surface graining method of the present invention is described in detail below.

Particularly preferred practical embodiments in the surface graining of an aluminum support of the present invention are as follows.

Practical Embodiment 1:

A method for producing an aluminum support for a lithographic printing plate, comprising subjecting an aluminum plate:

(1) to surface graining, (2) to polishing, and (3) to anodization in this order.

Practical Embodiment 2:

A method for producing an aluminum support for a lithographic printing plate, comprising subjecting an aluminum plate:

(1) to surface graining, (2) to polishing, (3) to surface graining, (4) to or not to polishing, and (5) to anodization in this order.

Practical Embodiment 3:

A method for producing an aluminum support for a lithographic printing plate, comprising subjecting an aluminum plate:

(1) to polishing or buff polishing, (2) to surface graining, (3) to or not to polishing, and (4) to anodization in this order.

In Practical Embodiments 1 to 3, it is more preferred to perform chemical etching before and/or after the polishing. The surface graining treatment is a treatment comprising a combination of one or more of mechanical surface graining, electrochemical surface graining, electrolytic polishing and chemical etching.

Practical Embodiment 4:

A method for producing an aluminum support for a lithographic printing plate, comprising subjecting an aluminum plate:

(1) to chemical etching or electrolytic polishing, (2) to preliminary electrochemical surface graining of from 1 to 300 C/dm$^2$ using an alternating current in an aqueous solution mainly comprising hydrochloric acid, (3) to chemical etching of from 0.1 to 1.0 g/m$^2$ in an aqueous alkali solution, (4) to electrochemical surface graining, (5) to chemical etching or electrolytic polishing, (6) to polishing, and (7) to anodization in this order.

Practical Embodiment 5:

A method for producing an aluminum support for a lithographic printing plate, comprising subjecting an aluminum plate:

(1) to mechanical surface graining, (2) to chemical etching or electrolytic polishing, (3) to electrochemical surface graining, (4) to chemical etching or electrolytic polishing, (5) to polishing, and (6) to anodization in this order.

Practical Embodiment 6:

A method for producing an aluminum support for a lithographic printing plate, comprising subjecting an aluminum plate:

(1) to mechanical surface graining, (2) to chemical etching or electrolytic polishing, (3) to preliminary electrochemical surface graining of from 1 to 300 C/dm$^2$ using an alternating current in an aqueous solution mainly comprising hydrochloric acid, (4) to chemical etching of from 0.1 to 1.0 g/m$^2$ in an aqueous alkali solution, (5) to electrochemical surface graining, (6) to chemical etching or electrolytic polishing, (7) to polishing, and (8) to anodization in this order.

In Practical Embodiments 1 to 6, it is more preferred to previously perform polishing or buff polishing.

In the present invention, the surface graining is preferably a treatment comprising a combination of one or more of mechanical surface graining, electrochemical surface graining, electrolytic polishing and chemical etching.

In the case where the surface graining is an electrochemical surface graining using DC or AC in an aqueous nitric acid solution, a preliminary surface graining treatment for producing fine irregularities is preferably performed before the electrochemical surface graining using DC or AC in an aqueous nitric acid solution.

The preliminary surface graining treatment preferably comprises:

(i) preliminary electrochemical surface graining of from 1 to 300 C/dm$^2$ using an alternating current in an aqueous solution mainly comprising hydrochloric acid, and (ii) chemical etching of from 0.1 to 1.0 g/m$^2$ in an aqueous alkali solution.

Before or after the polishing or before and after the polishing, chemical etching of dissolving an aluminum plate in an amount of from 0.01 to 30 g/m$^2$ is preferably performed.

The polishing is preferably performed using nylon brush, rubber, cloth, non-woven fabric, nylon non-woven fabric, sponge, felt, leather or burnishing cloth while spraying water or a solution having an etching effect on the aluminum or in water or a solution having an etching effect on the aluminum.

In the present invention, the polishing is performed while using an abrasive in combination.

In the present invention, chemical etching is performed before or after the electrolytic polishing or before and after the electrolytic polishing.

After the chemical etching, desmutting in an acidic aqueous solution is preferably performed.

After the anodization, hydrophilizing treatment is preferably performed.

When the surface of an aluminum support for a lithographic printing plate is observed through a scanning-type electron microscope to count the number of large wave projections and about 10% or more of angles in all projections are rounded, the aluminum support for a lithographic printing plate is advantageous in that the disinclination for catching of a sponge supplying fountain solution and the retardation to scumming of a printed matter are improved. Before the first surface graining, polishing is preferably performed.

When the surface of an aluminum support for a lithographic printing plate is observed through a scanning-type electron microscope to count the number of large wave projections and about 10% or more of angles in all projections are rounded by the polishing, the aluminum support for a lithographic printing plate is advantageous in that the disinclination for catching of a sponge supplying fountain solution and the retardation to scumming of a printed matter are improved.

The aluminum plate for use in the surface graining of the present invention or the aluminum support for a lithographic printing plate described in the present invention is preferably an aluminum plate produced by a DC casting method where intermediate annealing or soaking is omitted or intermediate annealing and soaking are omitted or by a continuous casting method where intermediate annealing is omitted, and the aluminum alloy particularly preferably contains hetero-elements in such a proportion that Si is from 0.05 to 1.0 wt %, Fe is from 0.1 to 1.0 wt %, Cu is from 0.01 to 0.2 wt %, Ti is from 0.01 to 0.1 wt %, Mn is from 0 to 1.5 wt %, Mg is from 0.0 to 0.3 wt %, and Zn is from 0 to 0.1 wt %.

The mechanical surface graining referred to in the present invention is preferably mechanical surface graining by means of a rotating nylon brush roller having a hair diameter of from 0.2 to 1.61 mm and a slurry solution supplied to the surface of an aluminum plate. The abrasive may be a known abrasive but quartz sand, quartz, aluminum hydroxide or a mixture thereof is preferred. These abrasives are described in detail in JP-A-6-135175 and JP-B-50-40047 (the term "JP-B" as used herein means an "examined Japanese patent publication"). The slurry solution preferably has a specific gravity of from 1.05 to 1.3.

Of course, a method of spraying a slurry solution, a method of using a wire brush, a method of transferring the surface shape of a rolling roller having irregularities onto an aluminum plate may also be used. Other methods are described in JP-A-55-074898, JP-A-61-162351 and JP-A-63-104889.

The electrochemical surface graining as referred to in the present invention means electrochemical surface graining using DC or AC in an aqueous solution mainly comprising a nitric acid or hydrochloric acid.

The chemical etching as referred to in the present invention means chemical dissolution of an aluminum plate by an aqueous acid or alkali solution.

The electrolysis polishing as referred to in the present invention means electrochemical polishing of an aluminum plate using DC or AC in an aqueous acid or alkali solution.

The aluminum plate for use in the present invention is selected from a pure aluminum plate, an alloy sheet mainly comprising aluminum and containing a trace hetero-element and a plastic film having laminated or evaporated thereon aluminum. The trace hetero-element is selected from those described in the Periodic Table of Elements and one or more elements are contained in an amount of from 0.001 to 1.5 wt %. Representative examples of the hetero-element contained in the aluminum alloy include silicon, iron, nickel, manganese, copper, magnesium, chromium, zinc, bismuth, titanium and vanadium. In usual, conventionally known materials described in Aluminum Handbook, 4th ed., Keikinzoku Kyokai (1990), for example, JIS A 1050 material, JIS A 3103 material, JIS A 3005 material, JIS A 1100 material, JIS A 3004 material, and alloys obtained by adding to these materials 5 wt % or less of magnesium for the purpose of increasing the tensile strength may be used. These are particularly suitable for the surface graining of an aluminum plate which undergoes generation of troubles ascribable to the orientation of the crystal grain. The proportion of hetero-elements contained in the aluminum alloy is preferably such that Si is from 0.03 to 1.0 wt %, Fe is from 0.05 to 1.0 wt %, Cu is from 0.001 to 0.2 wt %, Ti is from 0.01 to 0.1 wt %, Mn is from 0 to 1.5 wt %, Mg is from 0.0 to 0.3 wt %, and Zn is from 0 to 0.1 wt %, more preferably Si is from 0.05 to 0.15 wt %, Fe is from 0.1 to 0.3 wt %, Cu is from 0.1 to 0.02 wt %, Ti is from 0.02 to 0.03 wt %, Mn is from 0.01 to 0.03 wt %, Mg is from 0.01 to 0.03 wt %, and Zn is from 0.01 to 0.02 wt %.

If the above-described trace elements are contained in a large amount, uniform honeycomb pits are difficult to produce at the electrochemical surface graining in an acidic aqueous solution. If the Si component is contained in a large amount, a defective anodic oxide film is formed by the anodization after the surface graining and the defective part suffers from poor water receptivity to readily cause staining of paper at the printing. If the Cu component is contained in a large amount, the area of the part free of production of honeycomb pits increases to cause appearance failure. When the Si component is contained in a large amount, the amount of anodic oxide film determined by a gravimetric method is preferably from 3 to 10 g/m$^2$. If the amount of anodic oxide film is large, the anodic oxide film is liable to concentrate at the edge portion of aluminum. The difference in the amount of anodic oxide film between the edge portion and the center portion of an aluminum plate is preferably 1 g/m$^2$ or less.

After the anodization, hydrophilizing treatment may be sometimes performed by immersing the aluminum plate in an aqueous solution mainly comprising a silicic acid. The Si amount determined by a fluorescent X-ray apparatus is preferably from 0.1 to 100 mg/m$^2$, more preferably from 1 to 50 g/m$^2$.

The aluminum plate may be an aluminum plate produced by a usual DC casting method or an aluminum plate produced by a continuous cast-rolling method. Examples of the continuous cast-rolling method which can be used include twin-roll method, belt caster method and block caster method. The aluminum plate for use in the present invention has a thickness of approximately from 0.1 to 0.6 mm.

The aluminum plate easy to have unevenness in the alkali etching ascribable to the difference in the dissolution rate of aluminum due to the difference in the orientation of the crystal grain is preferably an aluminum plate produced by a DC casting method where the intermediate annealing or soaking is omitted or intermediate annealing and the soaking are omitted, or an aluminum plate produced by a continuous casting method where the intermediate annealing is omitted.

The term "aluminum plate easy to have treatment unevenness in the alkali etching ascribable to the difference in the dissolution rate of aluminum due to the difference in the orientation of the crystal grain" as used in the present invention means an aluminum plate on which streaky treatment unevenness called streak or defect called grainy unevenness is readily generated after the alkali etching.

The surface graining method of the present invention is suitable for the uniform graining of an aluminum alloy sheet in which when an aluminum plate is finished to have a mirror face by buff polishing of the surface thereof and alkali etched in an aqueous caustic soda solution so as to dissolve 15 g/m$^2$ of the aluminum plate, the difference in level generated due to difference in the etching rate is from 0.01 to 0.5 $\mu$m, preferably from 0.02 to 0.2 $\mu$m. On the observation of the surface of an aluminum plate which is buff polished and then etched by a hydrofluoric acid, the crystal grains long in the rolling direction have a width of from about 0.01 to 10 mm, preferably 5 mm or less, more preferably 3 mm or less, and a length of from 0.5 to 300 mm.

The apparatus for use in the electrochemical surface graining using DC or AC or in the electrolytic polishing of the present invention is any one of known apparatuses used in the continuous surface treatment of a metal web.

The aluminum plate surface grained by the present invention is preferably anodized so as to increase the abrasion resistance on the surface of an aluminum plate.

After the anodization or after the anodization and hydrophilizing treatment, a photosensitive layer or an intermediate layer and a photosensitive layer is(are) coated and dried according to a usual method. As a result, a PS plate having excellent printing performance can be obtained. On the photosensitive layer, a matting layer may be provided so as to attain good adhesion with the lith film at the vacuum printing. On the back surface, a backcoat layer may be provided for the purpose of preventing the dissolving out of aluminum at the development. The present invention may be applied not only to a single side treated PS plate but also a double side treated PS plate.

Furthermore, the present invention may be applied not only the surface graining of an aluminum support for a lithographic printing plate but also to the surface graining of any kind of aluminum plate.

The polishing treatment in the present invention is described in detail below.

The polishing treatment as used in the present invention means a mechanical, electrical, chemical or thermal polishing treatment.

Examples of the mechanical polishing include jet spraying of abrasive grains, jet spraying of water, jet spraying of magnetic abrasive grains, magnetic polishing, belt grinding, brushing and liquid horning. Examples of the electrical polishing include an ultrasonic method. Examples of the thermal polishing include treatments by plasma, discharge working or laser working. In view of industrial point, mechanical polishing is preferred, where the aluminum surface is preferably polished using a wheel or roller made of nylon brush, rubber, cloth, non-woven fabric, nylon non-woven fabric, sponge, felt, leather or burnishing cloth. A wet mechanical polishing treatment is preferred more than a dry mechanical polishing treatment, because a large scratch working out to an appearance failure is difficultly generated. The wet mechanical polishing is preferably performed while spraying water or a solution having an etching effect on aluminum or in water or a solution having an etching effect on aluminum. Irrespective of whether wet or dry, the polishing is preferably performed using an abrasive in combination because of high effect of rounding the surface with a small energy.

When the polishing is performed while etching the aluminum plate using an acid or alkali solution, the aluminum shavings or the like dissolve in the etching solution to scarcely generate scratches during the polishing. Furthermore, by performing the polishing while etching the aluminum plate using an acid of alkali solution, the scratches if generated can be prevented from showing up by the dissolving action of the etching solution. The amount of the aluminum plate etched while polishing the sheet is preferably from 0.001 to 4 g/m$^2$.

After the polishing, the aluminum plate is preferably subjected to water washing or chemical etching in an aqueous acid or alkali solution to dissolve the aluminum plate in an amount of from 0.01 to 1 g/m$^2$, so as to remove the shavings or abrasive.

When an aluminum plate is dissolved in an amount of from 0.01 to 30 g/m$^2$, preferably from 0.1 to 3 g/m$^2$ using an aqueous acid or alkali solution before the polishing, the surface of the aluminum plate is softened and the mechanical polishing is facilitated.

It is considered that by the mechanical polishing, the irregularities on the surface grained aluminum support are shaved, as a result, ink is scarcely caught at the printing and thereby scumming of the printed matter hardly occurs or a sponge is prevented from easy catching up at the time of supplying fountain solution.

The aluminum plate may be rubbed by nylon brush, sponge, rubber, non-woven fabric or leather for use in the mechanical polishing to have a flat surface or may be rotated using a roller material. When the aluminum plate is rotated using a roller material, a different in the rolling rate is preferably present between the aluminum plate and the outer periphery of the roller. The mechanical polishing is preferably performed using abrasives having an average particle size of from 0.001 to 0.1 $\mu$m as a polishing aid. Also, glass or zirconia balls having an average diameter of from 0.1 to 5 mm may be used as an aid. The abrasive preferably has a round shape reduced in the pointed angles as much as possible. Either the dry method or the wet method has an effect but from the standpoint that generation of scratches is difficult to occur, the wet method is more preferred. In the wet method, the liquid has a lubricating action and an action of cleaning shavings and therefore, generation of scratches is difficult occur. The liquid is preferably water because it is harmless, however, an aqueous acid or alkali solution having a concentration of from 0.01 to 30 wt % and containing aluminum ion of from 0 to 10 wt % may also be used. The aqueous acid or alkali solution specifically means caustic soda, sulfuric acid, phosphoric acid, nitric acid, hydrochloric acid or chromic acid. After the polishing using an alkali aqueous solution while performing etching, smut is generated. Accordingly, similarly to usual alkali etching, desmutting is preferably performed as an after treatment in an aqueous solution of sulfuric acid, phosphoric acid, nitric acid, hydrochloric acid or chromic acid. In the case of using a liquid containing an abrasive, an aqueous solution having a concentration of from 0.1 to 50 wt % is preferred. The abrasive is preferably alumina, silica, alumina hydroxide or the like. The wet treatment may be performed at a liquid temperature of from 10 to 90° C. The polishing is performed under a pressure of from 0.001 to 100 kg/cm$^2$ with a difference in the rate from the aluminum plate of from 0.001 to 100 m/sec.

In the polishing, a plurality of wheels, rollers or sections may be used in combination. In the case of using a plurality of such means in combination, it is preferred to combine steps different in the rotating direction alternately.

In the case where the polishing is performed while spraying water or an acid or alkali solution against the aluminum surface under polishing or by immersing the aluminum plate in a solution, the solution preferably has a viscosity of from 1 to 200 cp, more preferably from 1.5 to 50 cp. When the viscosity of the solution increases, a liquid coating is readily formed on the aluminum surface, as a result, the aluminum surface is not prone to scratches. The viscosity is increased by adding a thickener. The thickener is preferably a polymer compound. For example, polyethylene glycol is added in an amount of from 0.01 to 60 wt % or a polymer coagulant for use in the water treatment or waste water treatment is added in an amount of from 0.01 to 5 wt %. Examples of the polymer coagulant include nonionic coagulants, anionic coagulants and polyacrylic acid-based coagulants. Furthermore, commercial products available from Kurita Kogyo KK under the trade names of PN-161, PN-162, PN-133, PN-171, PA-328, PA-371, PA-322, PA-331, PA-349, PA-372, PA-318, PA-362, PA-363, PA-364, PA-365, PA-374, PA-375, PA-376, PA-377, PA-378, PA-379, PA-312, LC-541, LC-551 and the like may be used.

The aqueous solution mainly comprising hydrochloric acid for use in the present invention may be one used in usual electrochemical surface graining using DC or AC. For example, from 1 to 100 g/l of an aqueous hydrochloric acid solution having added thereto from 1 g/l to saturation of one or more of nitric acid compounds having nitrate ion such as aluminum nitrate, sodium nitrate and ammonium nitrate, and hydrochloric acid compounds having hydrochloride ion such as aluminum chloride, sodium chloride and ammonium chloride may be used. In the aqueous solution mainly comprising hydrochloric acid, metals contained in an aluminum metal, such as iron, copper, manganese, nickel, titanium, magnesium and silica may be dissolved. A hypochloric acid may also be added.

In order to preliminary produce fine irregularities using AC in an aqueous solution mainly comprising hydrochloric acid, an aqueous solution having a liquid temperature of from 15 to 45° C. and adjusted to have an aluminum ion of from 3 to 50 g/l by adding an aluminum salt to an aqueous solution containing from 5 to 15 g/l is more preferred.

With respective to additives to the aqueous solution mainly comprising hydrochloric acid, the apparatus, the power source, the current density, the flow rate and the temperature, those used in known electrochemical surface graining may be used. An aqueous solution mainly comprising nitric acid or hydrochloric acid is preferred. The power source for use in the electrochemical surface graining may be AC or DC and AC is preferred.

In the electrochemical surface graining in an aqueous solution mainly comprising hydrochloric acid, the quantity of electricity participating in the anodization of an aluminum plate is from 1 to 300 C/dm$^2$, preferably from 5 to 150 C/dm$^2$, more preferably from 10 to 100 C/dm$^2$.

After the production of fine irregularities by the electrochemical surface graining, smut or oxide film is produced. Accordingly, in order to uniformly perform next electrochemical surface graining, slight etching is preferably performed in an aqueous acid or alkali solution such that the aluminum plate is dissolved in an amount of from 0.01 to 3 g/m$^2$, more preferably from 0.01 to 1.5 g/m$^2$.

The preliminary electrochemical surface graining with a quality of electricity of from 1 to 300 C/dm$^2$ using AC in an aqueous solution mainly comprising hydrochloric acid is preferably performed such that the surface is free of non-etched portion but pits are uniformly formed throughout the surface, or even if non-etched parts are present, the non-etched parts are uniformly dispersed.

The electrolytic polishing in an aqueous alkali solution is described below.

The electrolytic polishing in an aqueous alkali solution as used in the present invention means an electrolytic treatment performed using aluminum as the anode in an aqueous solution containing solely an alkaline substance such as sodium hydroxide, potassium hydroxide, sodium carbonate and sodium phosphate, or a mixture of these alkaline substances, a mixture of the alkaline substance with zinc hydroxide or aluminum hydroxide, or a mixture of the alkaline substance with a salt such as sodium chloride or potassium chloride, adjusted to have an electrolytic solution composition, temperature and concentration capable of working out to an electrically deoxidizing material. In order to stably produce a uniform oxide film, hydrogen peroxide or phosphate may be added in a concentration of 1 wt % or less. Known aqueous solutions for use in electrolytic polishing may be used but an aqueous solution mainly comprising sodium hydroxide is preferred. An aqueous solution containing from 2 to 30 wt is more preferred and an aqueous solution containing from 3 to 20 wt % is sill more preferred. The liquid temperature, the current density and the electrolysis time may be selected from 10 to 90° C. (preferably from 35 to 60° C.), from 1 to 200 A/dm$^2$ (preferably from 20 to 80 A/dm$^2$), and from 1 to 180 seconds, respectively. The current may be DC pulse DC or AC, but a continuous DC is preferred. The apparatus for the electrolytic treatment may be a conventionally known one used in the electrolytic treatment, such as flat-type bath or radial-type bath.

After the completion of treatment, liquid squeezing by nip rollers and washing by spraying water are preferably performed so as to prevent the carrying over of the treating solution into the next step.

More preferably, chemical etching in an aqueous acid or alkali solution is performed before or after the electrolytic polishing or before and after the electrolytic polishing such that the aluminum plate is dissolved in an amount of from 0.01 to 3 g/m$^2$.

To the aqueous alkali solution, a water-soluble polymer compound may be added as a thickener in an amount of from 0.1 to 60 wt % to increase the viscosity of the electrolytic solution, so that the projected part of a pit produced by the electrochemical surface graining can be preferentially dissolved with ease and a printing plate not prone to scumming at the printing can be manufactured with the reduction in the amount of aluminum dissolved. Also, it is more preferred to add from 0.001 to 10 g/l of a brightener such as a surface active agent. Examples of the water-soluble polymer compound include polyvinyl alcohol. A water-soluble polymer compound having an average molecular weight of from 200 to 20,000 may be used but a polymer compound having an average molecular weight of 600 or less is preferably used because it is liquid.

Other examples of the method for increasing the viscosity of the electrolytic solution include a method of adding a polymer coagulant used in the water treatment or waste water treatment in an amount of 0.01 to 5 wt %. The polymer coagulant include nonionic coagulants, anionic coagulants and polyacrylic acid-based coagulants. Furthermore, commercial products available from Kurita Kogyo KK under the trade names of PN-161, PN-162, PN-133, PN-171, PA-328, PA-371, PA-322, PA-331, PA-349, PA-372, PA-318, PA-362, PA-363, PA-364, PA-365, PA-374, PA-375, PA-376, PA-377, PA-378, PA-379, PA-312, LC-541, LC-551 and the like may be used.

The electrolytic polishing in an acidic aqueous solution for use in the present invention is described below.

The aqueous solution for use in the electrolytic polishing of an aluminum plate in an acidic aqueous solution referred to in the present invention may be a known aqueous solution used in the electrolytic polishing but an aqueous solution mainly comprising a sulfuric acid or a phosphoric acid is preferred. The aqueous solution preferably contains from 20 to 90 wt % (more preferably from 40 to 80 wt %) of a sulfuric acid or a phosphoric acid. The liquid temperature is from 10 to 90° C. (preferably from 50 to 80° C.), the current density is from 1 to 200 A/dm$^2$ (preferably from 5 to 80 A/dm$^2$), and the electrolysis time is from 1 to 180 seconds. To this aqueous solution, sulfuric acid, phosphoric acid, chromic acid, hydrogen peroxide, boric acid, hydrofluoric acid or phthalic anhydride may be added in an amount of from 1 to 50 wt %. Furthermore, the aqueous solution may contain from 0 to 10 wt % of aluminum or an alloy component contained in the aluminum alloy. The concentration of sulfonate ion or phosphate ion and the concentration of aluminum ion each is preferably a concentration of not causing crystallization even at an ordinary temperature.

The current may be DC, pulse DC or AC but preferably continuous DC. The apparatus for the electrolytic treatment may be a known one used in the electrolytic treatment, such as a flat type bath or a radial type bath. After the completion of treatment, liquid squeezing by nip rollers and washing by spraying water are preferably performed so as to prevent the carrying over of the treating solution into the next step.

More preferably, chemical etching in an aqueous acid or alkali solution is performed before or after the electrolytic polishing or before and after the electrolytic polishing such that the aluminum plate is dissolved in an amount of from 0.01 to 3 g/m$^2$.

To the acidic aqueous solution, a water-soluble polymer compound may be added as a thickener to increase the viscosity of the electrolytic solution as described in JP-A-57-44000, so that the projected part of a pit produced by the electrochemical surface graining can be preferentially dissolved with ease and a printing plate not prone to scumming at the printing can be manufactured with the reduction in the amount of aluminum dissolved. Also, it is more preferred to add from 0.001 to 10 g/l of a brightener such as a surface active agent. Examples of the water-soluble polymer compound include polyvinyl alcohol. A water-soluble polymer compound having an average molecular weight of from 200 to 20,000 may be used but a polymer compound having an average molecular weight of 600 or less is preferably used because it is liquid.

The chemical etching in an aqueous acid or alkali solution for use in the present invention is described below.

The aqueous alkali solution preferably has a concentration of from 1 to 30 wt % and may contain of course aluminum or even an alloy component contained in the aluminum alloy, in an amount of from 0 to 10 wt %. The aqueous alkali solution is preferably an aqueous solution mainly comprising caustic soda. The treatment is preferably performed at a liquid temperature of from ordinary temperature to 95° C. for from 1 to 120 seconds.

Examples of the acid which can be used in the acidic aqueous solution include phosphoric acid, nitric acid, sulfuric acid, chromic acid, hydrochloric acid and a mixed acid containing two or more of these acids. The acidic aqueous solution preferably has a concentration of from 0.5 to 65 wt % and may contain of course aluminum or even an alloy component contained in the aluminum alloy, in an amount of from 0 to 10 wt %. The treatment is preferably performed at a liquid temperature of from 30 to 95° C. for from 1 to 120 seconds. The aqueous acid solution is preferably an aqueous solution mainly comprising sulfuric acid. The sulfuric acid concentration and the aluminum concentration each is preferably selected from the range of not causing crystallization at an ordinary temperature.

After the completion of etching, liquid squeezing by nip rollers and washing by spraying water are preferably performed so as to prevent the carrying over of the treating solution into the next step.

The desmutting in an acidic aqueous solution is described below.

In the case where the chemical etching is performed using an aqueous alkali solution, smut is generally produced on the surface of aluminum. In this case, desmutting is performed with phosphoric acid, nitric acid, sulfuric acid, chromic acid, hydrochloric acid or a mixed acid containing two or more of these acids. The acidic aqueous solution preferably has a concentration of from 0.5 to 60 wt %. In the acidic aqueous solution, of course aluminum or even an alloy component contained in the aluminum alloy may be dissolved in an amount of approximately from 0 to 5 wt %. The treatment is performed at a liquid temperature of from an ordinary temperature to 95° C. for a treatment time of from 1 to 120 seconds. After the completion of desmutting, liquid squeezing by nip rollers and washing by spraying water are preferably performed so as to prevent the carrying over of the treating solution into the next step.

Aqueous Solution Mainly Comprising Nitric Acid:

The aqueous solution mainly comprising nitric acid referred to in the present invention may be one used in ordinary electrochemical surface graining using DC or AC. For example, from 1 to 400 g/l of an aqueous nitric acid solution having added thereto from 1 g/l to saturation of one or more of nitric acid compounds having nitrate ion such as aluminum nitrate, sodium nitrate and ammonium nitrate, and hydrochloric acid compounds having hydrochloride ion such as aluminum chloride, sodium chloride and ammonium chloride, may be used. In the aqueous solution mainly comprising nitric acid, metals contained in an aluminum alloy, such as iron, copper, manganese, nickel, titanium, magnesium and silica, may be dissolved. In particular, a solution having added thereto aluminum chloride or aluminum nitrate such that aluminum ion is present in an amount of from 3 to 50 g/l in an aqueous solution containing from 5 to 20 g/l of nitric acid, is preferably used. The temperature is preferably from 10 to 95° C., more preferably from 40 to 80° C.

The electrochemical surface graining using AC for use in the present invention is described below.

The acidic aqueous solution for use in the present invention may be an aqueous solution used in usual electrochemical surface graining using DC or AC. An aqueous solution selected from the above-described aqueous solutions mainly comprising nitric acid or hydrochloric acid may be used advantageously.

The AC power source for use in the electrochemical surface graining may have a waveform such as sign wave, rectangular wave, trapezoidal wave and triangular wave. The rectangular wave and trapezoidal wave are preferred and the trapezoidal wave is more preferred. The frequency is preferably from 0.1 to 250 Hz.

FIG. 1 shows one example of the trapezoidal wave which is preferably used in the present invention. In the trapezoidal wave, the time tp until the current started from 0 reaches the peak is preferably from 0.1 to 10 msec, more preferably from 0.3 to 2 msec. If the tp is less than 1, a large power source voltage is necessary at the first transition of the trapezoidal waveform due to the effect of impedance of the power source circuit and this causes rising in the cost for the power source equipment, whereas if tp exceeds 10 msec, the treatment is readily affected by the trace component in the electrolytic solution and uniform surface graining cannot be easily attained.

The conditions in one cycle of AC for use in the electrochemical surface graining are preferably such that the ratio tc/ta of the anode reaction time ta of the aluminum plate to the cathode reaction time tc is from 1 to 20, the ratio Qc/Qa of the electricity quantity Qc at the cathode time of the aluminum plate to the electricity quantity Qa at the anode time is from 0.3 to 20 and the cathode reaction time ta is from 5 to 1,000 msec, more preferably tc/ta is from 2.5 to 15 and Qc/Qa is from 2.5 to 15.

The current density in terms of the peak value of the trapezoidal wave is preferably from 10 to 200 A/dm$^2$ both in the anode cycle side Ia and the cathode cycle side Ic of the current. Ic/Ia is preferably from 0.3 to 20.

The total quantity of electricity participating in the anode reaction of the aluminum plate is preferably from 1 to 1,000 C/dm$^2$ at the time when the electrochemical surface graining is completed.

The electrolytic bath for use in the electrochemical surface graining using AC of the present invention may be a known electrolytic bath used in the surface treatment, such as vertical type, flat type and radial type, however, a radial-type electrolytic bath described in JP-A-5-195300 is preferred. The electrolytic solution passing through the electrolytic bath may run parallel or counter to the progress of the aluminum web. To one electrolytic bath, one or more AC power sources may be connected. Also, two or more electrolytic baths may be used.

Figure 2:
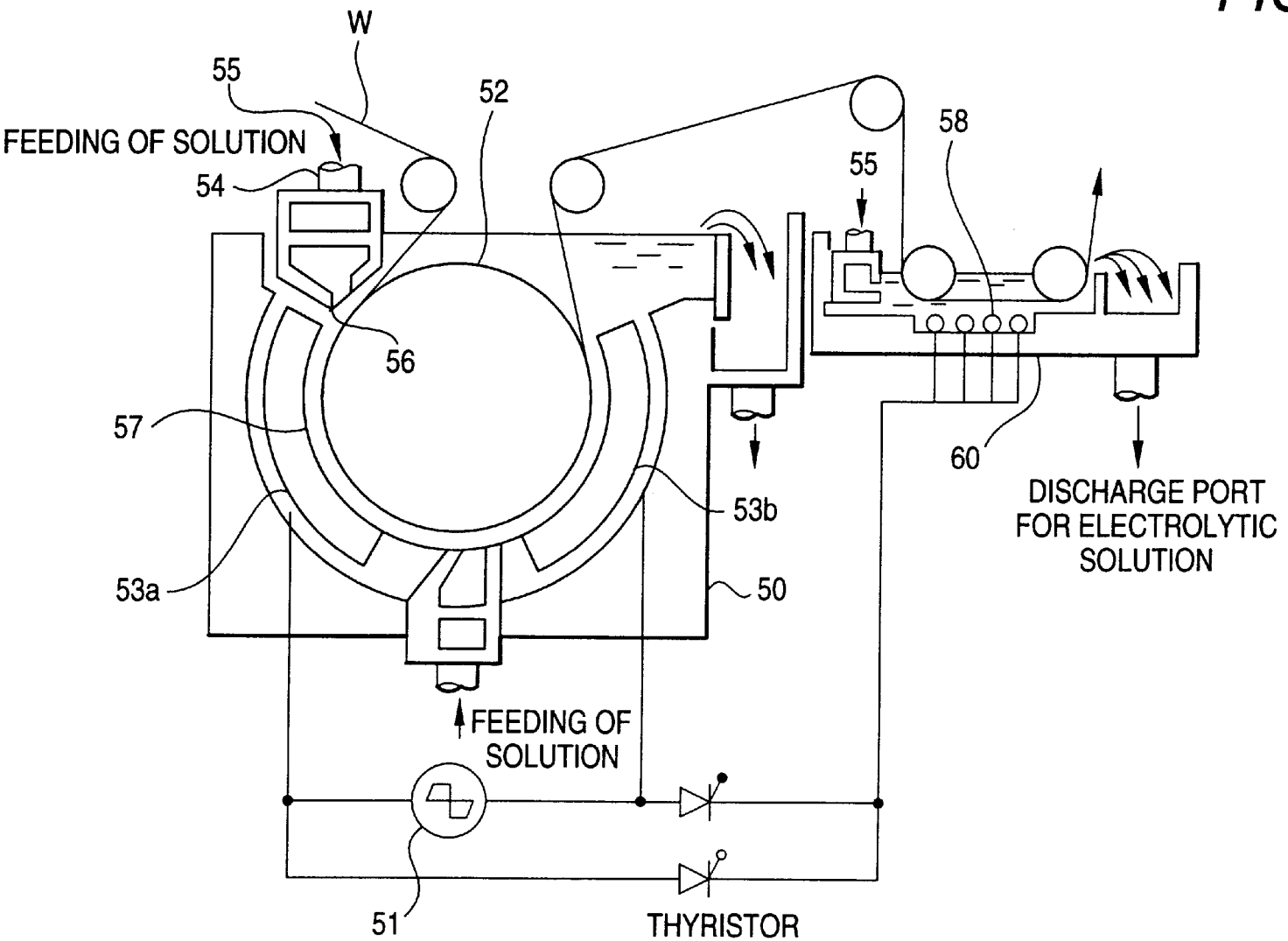
FIG. 2 is a schematic view showing one example of the electrolysis apparatus for use in the electrochemical surface graining of the present invention.

For the electrochemical surface graining using AC, an apparatus shown in FIG. 2 may be used. When two or more electrolytic baths are used, the electrolysis conditions may be the same or different.

An aluminum plate W is fed by winding it around a radial drum roller 52 immersed in a main electrolytic bath 50 and electrolyzed on the way of transportation by main electrodes 53*a* and 53*b* connected to an AC power source 51. An electrolytic solution 55 is supplied from an electrolytic solution supply port 54 to an electrolytic solution path 57 between the radial drum roller 52 and the main electrode 53*a* or 53*b* through a slit 56. The aluminum plate W treated in the main electrolysis tank 50 is then electrolyzed in an auxiliary anode bath 60. In this auxiliary anode bath 60, an auxiliary anode 58 is disposed to oppose the aluminum plate W and the electrolytic solution is supplied to run through the space between the auxiliary anode 58 and the aluminum plate W.

Electrochemical Surface Graining Using DC:

The electrochemical surface graining using DC as used in the present invention means a method of performing electrochemical surface graining by applying a DC current between an aluminum plate and an electrode opposing it. The electrolytic solution may be a known electrolytic solution used in the electrochemical surface graining using DC or AC. An electrolytic solution selected from the above-described aqueous solutions mainly comprising nitric acid or hydrochloric acid may be advantageously used. The temperature is preferably from 10 to 80° C. The apparatus for the electrochemical surface graining using DC may be a known apparatus using DC, however, an apparatus described in JP-A-1-141094 is preferred, where one or more pair of anode and cathode are alternately arranged. Examples of known apparatuses include those described in JP-A-6-328876, JP-A-8-67078, JP-A-61-19115 and JP-B-57-44760. Also, the electrochemical surface graining may be performed by applying DC between a conductor roll in contact with an aluminum plate and a cathode opposing it and using the aluminum plate as the anode. After the completion of electrolysis treatment, liquid squeezing by nip rollers and washing by spraying water are preferably performed so as to prevent the carrying over of the treating solution into the next step. The DC for use in the electrochemical surface graining is preferably a DC having a ripple ratio of 20% or less. The current density is preferably from 10 to 200 A/dm$^2$ and the quantity of electricity when the aluminum plate is at the anode time is preferably from 1 to 1,000 C/dm$^2$. The anode which can be used may be selected from known electrodes for use in the oxygen generation, such as ferrite, iridium oxide, platinum, and platinum-cladded titanium, niobium, zirconium or the like valve metal. The cathode which can be used may be carbon, platinum, titanium, niobium, zirconium or stainless steel or may be selected from the electrodes used as a cathode of fuel cells.

The anodization for use in the present invention is described below.

The aluminum plate is subjected to anodization so as to increase the abrasion resistance on the surface thereof. The electrolyte for use in the anodization of an aluminum plate may be any as far as a porous oxide film can be formed. In general, sulfuric acid, phosphoric acid, oxalic acid, chromic acid or a mixed solution thereof is used. The concentration of the electrolyte is appropriately decided depending on the kind of the electrolyte. The conditions for the anodization varies depending on the electrolyte used and cannot be indiscriminately specified, however, it may suffice in general if the electrolyte concentration is from 1 to 80 wt %, the liquid temperature is from 5 to 70° C., the current density is from 1 to 60 A/dm$^2$, the voltage is from 1 to 100 V, and the electrolysis time is from 10 to 300 sec.

The treatment by a sulfuric acid method is usually performed using DC but may also be performed using AC. The amount of the anodic oxide film is appropriately from 1 to 10 g/m$^2$. If it is less than 1 g/m$^2$, the printing durability is not sufficiently long or the non-image area of a lithographic printing plate manufactured is readily scratched to cause adhesion of ink to the scratched part, so-called scratch soiling.

After the anodization, the aluminum surface is, if desired, subjected to hydrophilizing treatment. examples of the hydrophilizing treatment for use in the present invention include an alkali metal silicate (e.g., an aqueous sodium silicate solution) method described in U.S. Pat. Nos. 2,714,066, 3,181,461, 3,280,734 and 3,902,734. According to this method, the support is immersed or electrolyzed in an aqueous sodium silicate solution. Other examples include treatments with potassium fluorozirconate disclosed in JP-B-36-22063 or with a polyvinyl phosphonic acid disclosed in U.S. Pat. Nos. 3,276,868, 4,153,461 and 4,689,272.

An aluminum plate is preferably subjected to sealing after the graining and anodization. The sealing is performed by the immersion in a hot aqueous solution containing hot water and an inorganic or organic salt and then in a steam bath or the like.

The useful quality of the aluminum surface is decided by the surface structure, lubricity and color properties thereof. The fine structure on the surface of an aluminum support greatly affects the performance of the sheet used as a support of a lithographic printing plate. It has been found that an excellent lithographic printing plate can be obtained by virtue of the surface properties of an aluminum plate produced by the present invention. The aluminum plate has a hard and durable surface favored with excellent affinity for water and superior adhesion to the photosensitive layer. Furthermore, the aluminum plate of the present invention can be kept white even after the anodization and free of unevenness, therefore, the lithographic printing plate manufactured therefrom can have good contrast. Due to the high contrast between the image area and the non-image area, the printer can easily inspect the quality of the image area. Furthermore, the lithographic printing plate is prevented from easy stripping of the image region owing to the distribution of peaks and troughs constituting the surface structure, accordingly, can have excellent printing durability. Moreover, the surface is suppressed in the gloss and scarcely glares, so that the amount of fountain water at the printing can be easily inspected by an operator of the printing machine. To this effect, the aluminum support for a lithographic printing plate preferably has parameters for the structure of the roughened surface falling within the following ranges.

The support for a lithographic printing plate having a surface subjected to surface graining and then anodization has two-dimensional roughness parameters such that Ra is from 0.1 to 1 $\mu$m, Ry is from 1 to 10 $\mu$m, Rz is from 1 to 10 $\mu$m, Sm is from 5 to 80 $\mu$m, S is from 5 to 80 $\mu$m, Rt is from 1 to 10 $\mu$m, Rp is from 1 to 10 $\mu$m and Rv is from 1 to 10 $\mu$m.

The support for a lithographic printing plate having a surface subjected to surface graining and then anodization has three-dimensional roughness parameters such that SRp is from 1 to 15 μm, SRv is from 1 to 20 μm, SRmax is from 5 to 30 μm, SRa is from 0.1 to 2 μm, SGr is from 50 to 500 μm, SSr is from 10 to 90%, SRz is from 5 to 30 μm, SRq is from 0.5 to 3 μm, SRsk is from −0.9 to +0.9, SΔa is from 0.2 to 1.5 radian and Sλa is from 5 to 20 μm.

The parameters for the surface roughness may be measured by a trace method roughness meter or an optical roughness meter.

When the tristimulus chromaticity coordinate values L, a and b on the surface of a printing plate provided are measured, L is from about 35.00 to about 95.0, a is from about −4.00 to about +4.00, and b is from about −4.00 to about +4.00.

The 85° glossiness is from 1 to 40, the 70° glossiness is from 1 to 15, the 60° glossiness is from 1 to 10, the 45° glossiness is from 1 to 10, and the 20° glossiness is from 1 to 5.

The above-described parameters are defined as follows.

(1) Two-Dimensional Roughness Parameters

Ra: Center Line Average Height:

A portion of the measured length L is extracted from the roughness curve in the direction of center line and an arithmetic mean of absolute values in the deviation between the center line and the roughness curve in this extracted portion is used as a center line average height.

Ry: Maximum Height:

A portion just in the standard length is extracted from the roughness curve in the direction of center line and the interval between the crest line and the trough line in this extracted portion is determined in the direction of longitudinal magnification of the roughness curve and used as a maximum height.

Rz: Ten Point Average Height:

A portion just in the standard length is extracted from the roughness curve in the direction of the average value thereof, an average of absolute values in the height (Yp) of from highest to fifth crests and an average of absolute values in the height (Yv) of from lowest to fifth troughs, measured in the direction of longitudinal magnification from the center line in this extracted portion are determined, and the sum of averages is shown by μm and used as a ten point average height.

Sm: Average Interval of Irregularities:

A portion just in the standard length is extracted from the roughness curve in the direction of the average value thereof, the sum of average lines each corresponding to the distance between one crest and one trough in this extracted portion is determined, and an arithmetic mean of intervals of these many irregularities is shown by mm and used as an average interval of irregularities.

S: Average Interval of Local Crests:

The length of each average line corresponding to the interval between local crests is determined and an arithmetic mean of the intervals of these many local crests is shown by mm and used as an average interval of local rests.

Rt: Maximum Height:

A portion just in the standard length is extracted from the roughness curve, two straight lines in parallel to the center line are drawn-to sandwich the extracted portion and the distance between these two straight lines is used as a maximum height.

Rp: Center Line Crest Height:

A portion just in the standard length is extracted from the roughness curve in the direction of the average value thereof and the distance between the average line and a line running in parallel thereto and passing through the highest crest is used as a center line crest height.

Rv: Center Line Trough Depth:

A portion of the measured length L is extracted from the roughness curve in the direction of the center line and the distance between the center line and a line running in parallel thereto and passing through the deepest root is used as a center line trough depth.

(2) Three-Dimensional Roughness Parameters

SRp: Center Plane Crest Height:

The distance between the center plane and the highest crest on the roughness curved face is used as a center plane crest height.

SRv: Center Plane Trough Depth:

The distance between the center plane and the lowest trough on the roughness curved face is used as a center plane trough depth.

SRmax: Maximum Height:

The distance between two planes in parallel to the average plane on the sectional curved face and sandwiching the sectional curved face is used as a center plane crest height.

SRa: Center Line Average Height:

Rectangular coordinate axes X and Y are placed on the center plane of the roughness curved face, an axis meeting the center plane at a right angle is assumed as the axis Z, and a value calculated from the roughness curved face f(X,Y) and the size Lx,Ly of the standard plane is used as the center line average height.

SGr: Center Plane Area Ratio:

An average area of substantial particles appearing on the center plane of the roughness curved face.

SSr: Central Area Ratio:

The ratio between the substantial area and the standard area on the center plane of the roughness area is shown by a percentage (%) and used as a central area ratio.

SRz: Ten Point Average Height:

The distance between the average height of from highest to fifth crests and the average depth of from the deepest to fifth roots, with respect to the average plane of the sectional curved face is used as a ten point average roughness.

SRq:

The amplitude from the center line on the two-dimensional roughness curve is expressed by an effective value and a value three-dimensionally calculated therefrom is used as SRq.

SRsK:

The value indicating the symmetry of the amplitude distribution curve in the direction of longitudinal magnification of the roughness curve is three-dimensionally calculated and used as SRsK.

SΔa: Average Inclination Grade:

Rectangular coordinate axes X and Y are placed on the center line of the roughness curved face, an axis meeting the center plane at a right angle is assumed as the axis Z, and a value calculated from the roughness curved face f(X,Y) and the size Lx,Ly of the standard plane is used as the average inclination grade.

Sλa: Average Wavelength:

Sλa is π*SRa/SΔa.

The aluminum plate for use in the present invention includes pure aluminum and aluminum alloys. For the aluminum alloy, various materials may be used and, for example, an alloy of silicon, copper, manganese, magnesium, chromium, zinc, lead, nickel or bismuth with aluminum is used. The aluminum alloy includes various aluminum alloys and examples thereof include, as an offset printing plate material, an aluminum alloy disclosed in JP-B-58-6635 (the term "JP-B" as used herein means an "examined Japanese patent publication") where Fe and Si components are specified and a specific intermetallic compound is used, an aluminum alloy disclosed in JP-B-55-28874 where cold rolling and intermediate annealing are performed and the method for applying an voltage in the electrolytic surface graining is limited, and aluminum alloys disclosed in JP-B-62-41304, JP-B-1-45677, JP-A-1-46578, JP-B-1-47545, JP-B-1-35910, JP-B-63-60823, JP-B-63-60824, JP-B-4-13417, JP-B-4-19290, JP-B-4-19291, JP-B-4-19293, JP-B-62-50540, JP-A-61-272357, JP-A-62-74060, JP-A-61-201747, JP-A-63-143234, JP-A-63-143235, JP-A-63-255338, JP-A-1-283350, EP272528, U.S. Pat. Nos. 4,902,353 and 4,818,300, EP394816, U.S. Pat. No. 5,010,188, West German Patent 3,232,810, U.S. Pat. No. 4,352,230, EP239995, U.S. Pat. No. 4,822,715, West German Patent 3,507,402, U.S. Pat. No. 4,715,903, West German Patent 3,507,402, EP289844, U.S. Pat. Nos. 5,009,722 and 4,945,004, West German Patent 3,714,059, U.S. Pat. Nos. 4,686,083 and 4,861,396 and EP158941. Not only those described in these patent publications but also any other general aluminum alloys may be used. With respect to the production method of the plate material, a method by continuous casting has been filed as a patent other than the method using hot rolling. For example, East German Patent 252799 introduces a plate material produced by a twin roll system, EP 223737 and U.S. Pat. Nos. 4,802,935 and 4,800,950 disclose techniques where the trace alloy components are limited, and EP415238 proposes continuous casting or continuous casting and hot rolling.

In the present invention, such an aluminum plate is subjected to various surface treatments and transfer, so that a printing original plate having uniform irregularities can be obtained. By providing thereon a photosensitive layer such as diazo compound, an excellent photosensitive lithographic printing plate can be obtained. In any case, it is necessary to select proper materials.

Depending on the case, degreasing may be first performed. In performing degreasing, a method of using a solvent or surface active material such as Tricrene, or an alkali etching agent such as sodium hydroxide and potassium hydroxide is commonly known. JP-A-2-026793 describes the degreasing. For example, the solvent degreasing includes a method of using a petroleum-based solvent such as gasoline, kerosine, benzine, solvent naphtha and normal hexane, and a method of using a chlorine-based solvent such as trichloroethylene, methylene chloride, perchloroethylene and 1,1,1-trichloroethane. The alkali degreasing includes a method of using an aqueous solution of sodium salt such as sodium hydroxide, sodium carbonate, sodium bicarbonate and sodium sulfate, a method of using an aqueous solution of silicate such as sodium orthosilicate, sodium metasilicate, sodium silicate No. 2 and sodium silicate No. 3, and a method of using an aqueous solution of phosphate such as sodium primary phosphate, sodium tertiary phosphate, sodium secondary phosphate, sodium tripolyphosphate, sodium pyrophosphate and sodium hexametaphosphate. In the case of using alkali degreasing, the aluminum surface may dissolve depending on the processing time or processing temperature, therefore, the degreasing must be performed not to cause the dissolution phenomenon. The degreasing by a surface active agent uses an aqueous solution of anionic surface active agent, cationic surface active agent, nonionic surface active agent or amphoteric active agent. Various commercially available surface active agents may also be used. With respect to the method for degreasing, a immersing method, a spraying method or a method of rubbing by a cloth or the like impregnated with a solution may be used. In the immersing or spraying method, an ultrasonic wave may also be used.

In the case where preliminary polishing is performed, electrochemical polishing is performed by a direct current (dc) electrolysis in a sulfuric acid solution. Conditions for the electrochemical polishing are suitably such that the sulfuric acid concentration is from 15 to 80%, the temperature is from 40 to 80° C., the power source is dc, the current density is from 5 to 50 A/dm$^2$ and the quantity of electricity is from 100 to 3,000 c/dm$^2$. In the case of mechanical polishing, the preliminary polishing is preferably performed using a roller prepared by incorporating abrasives having an average particle size of from 1 to 25 $\mu$m into a non-woven fabric constituted by polyamide, polyester, rayon or the like. The conditions for preliminary polishing must be selected so that surface roughness to a certain extent can be maintained. The roller size is from 200 to 1,000 mm and in order to maintain uniform surface quality, vibrations of from 5 to 2,000 times/min are preferably applied in the direction perpendicular to the rolling direction of the original plate or in the case of continuous treatment, perpendicularly to the line direction. In either case, it is important to achieve a center line surface roughness of from 0.15 to 0.35 $\mu$m and a maximum surface roughness of from 1 to 3.5 $\mu$m by the preliminary polishing. In other words, it is important not only in the above-described dc electrolysis and/or roller preliminary polishing to attain a desired center line average height and a desired maximum surface roughness.

The mechanical surface graining includes various methods using transfer, brush, liquid horning or the like, and the method must be selected by taking account of productivity and the like.

The transfer method where a surface having irregularities is contacted under pressure with an aluminum plate includes various methods. For example, methods disclosed in JP-A-55-74898, JP-A-60-36195 and JP-A-60-203496 supra, a method disclosed in JP-A-6-55871 where the transfer is performed several times, and a method disclosed in JP-A-6-24168 where the surface is elastic may be appropriately used.

Furthermore, the transfer may be repeatedly performed using a roller having etched thereon fine irregularities by discharge work, shot blast, laser or plasma etching. Also, a surface having irregularities as a result of coating fine particles may be contacted with an aluminum plate and a pressure may be repeatedly applied thereon, so that a pattern of irregularities corresponding to the average diameter of fine particles can be repeatedly transferred to the aluminum plate.

For imparting fine irregularities to a transfer roller, methods described in JP-A-5-08635, JP-A-3-066404 and JP-A-63-065017 are known. Also, angular irregularities may be imparted on the surface of a roller by cutting fine grooves on the surface from two directions using die, bite or laser. This roller surface may be subjected to a known etching treatment so that the angular irregularities formed can be rounded. Needless to say, quenching or hard chrome plating may be performed to increase the surface hardness.

The surface graining by a brush includes surface graining by a nylon brush and surface graining by a wire brush. The surface graining by high-pressure water is described in JP-A-59-21469, JP-A-60-19595 and JP-A-60-18390.

The aluminum plate treated by such mechanical surface graining is, if desired, subjected to chemical treating of the aluminum surface with an acid or alkali so as to smooth and equalize the aluminum plate. This is because if electrochemical surface graining is performed directly subsequent to the transfer, uneven surface graining results. Specifically, examples of the chemical treatment using an acid or alkali include a method of using an aqueous solution of acid such as phosphoric acid, sulfuric acid, hydrochloric acid and nitric acid, a method of using an aqueous solution of sodium salt such as sodium hydroxide, sodium carbonate, sodium bicarbonate and sodium sulfate, a method of using an aqueous solution of silicate such as sodium orthosilicate, sodium metasilicate, sodium silicate No. 2 and sodium silicate No. 3, and a method of using an aqueous solution of phosphate such as sodium primary phosphate, sodium tertiary phosphate, sodium secondary phosphate, sodium tripolyphosphate, sodium pyrophosphate and sodium hexametaphosphate. The treatment conditions are appropriately selected such that the concentration is from 0.01 to 50 wt %, the temperature is from 20 to 90° C. and the time is from 5 seconds to 5 minutes. The etching amount is appropriately selected depending on the constructive material of aluminum or the quality demanded. JP-A-54-65607 and JP-A-55-125299 propose a pretreatment of electrochemical surface graining. Various pretreatments are described in JP-A-63-235500, JP-A-63-307990, JP-A-1-127388, JP-A-1-160690, JP-A-1-136789, JP-A-1-136788, JP-A-1-178497, JP-A-1-308689, JP-A-3-126871, JP-A-3-126900 and JP-A-3-173900, however, the present invention is by no means limited thereto. After the chemical treatment of the aluminum surface with an aqueous solution of acid or alkali, an insoluble residue part, namely, smut is produced on the surface. This smut can be removed by a phosphoric acid, a nitric acid, a sulfuric acid, a chromic acid or a mixture thereof. In the present invention, the aluminum surface for use in the electrochemical surface graining is preferably a clean surface free of smut. However, in the case where the electrolytic solution is an acid and has a desmutting action, the step for removing smut may be omitted.

The thus-treated aluminum plate is subjected to electrochemical surface graining and during the electrolytic surface graining, smut is removed by the same components as the electrolytic solution. The electrochemical surface graining is described in JP-B-48-28123 and British Patent 896,563. In the electrolytic surface graining, a sine waveform alternating current (ac) has been heretofore used, however, a special waveform described in JP-A-52-58602 may also be used. Furthermore, methods described in JP-A-55-158298, JP-A-56-28898, JP-A-52-58602, JP-A-52-152302, JP-A-54-85802, JP-A-60-190392, JP-A-58-120531, JP-A-63-176187, JP-A-1-5889, JP-A-1-280590, JP-A-1-118489, JP-A-1-148592, JP-A-1-178496, JP-A-1-188315, JP-A-1-154797, JP-A-2-235794, JP-A-3-260100, JP-A-3-253600, JP-A-4-72079, JP-A-4-72098, JP-A-3-267400 and JP-A-1-141094 may be used.

With respect to the frequency, frequencies for electrolytic capacitors proposed, for example, in U.S. Pat. Nos. 4,276,129 and 4,676,879, may be used other than those described above.

The electrolytic solution which can be used includes the above-described nitric acid, hydrochloric acid and the like, and additionally includes electrolytic solutions described in U.S. Pat. Nos. 4,671,859, 466,576, 4,661,219, 4,618,405, 462,628, 4,600,482, 4,566,960, 4,566,958, 4,566,959, 4,416,972, 4,374,710, 4,336,113 and 4,184,932. With respect to the electrolysis tank and power source, various proposals have been made and described in U.S. Pat. No. 4,203,637, JP-A-56-123400, JP-A-57-59770, 53-12738, JP-A-53-32821, JP-A-53-32822, JP-A-53-32823, JP-A-55-122896, JP-A-55-132884, JP-A-62-127500, JP-A-1-52100, JP-A-1-52098, JP-A-60-67700, JP-A-1-230800 and JP-A-3-25199. Other than in these patent publications, various proposals have been made and, for example, those described in JP-A-52-58602, JP-A-52-152302, JP-A-53-12738, JP-A-53-12739, JP-A-53-32821, JP-A-53-32822, JP-A-53-32833, JP-A-53-32824, JP-A-53-32825, JP-A-54-85802, JP-A-55-122896, JP-A-55-132884, JP-B-48-28123, JP-B-51-7081, JP-A-52-133838, JP-A-52-133840, JP-A-52-133844, JP-A-52-133845, JP-A-53-149135 and JP-A-54-146234 may of course be used.

Desmutting is performed by a solution having the same components as the electrolytic solution as described above. If desmutting is performed by a solution having different components from the electrolytic solution, a water washing step is necessary after the desmutting and this not only gives rise to increase in the cost but also affects the electrolytic graining property. Use of the same components is advantageous in that even if the temperature or concentration is changed in the desmutting system, the temperature or concentration can be manage or controlled in the electrolytic surface graining step. The smut may be removed by chemically dissolving the smut or may be forcedly removed by colliding a solution against the web at a high speed by a spray or the like. The method may be selected by taking account overall of the productivity, equipment cost, cell shape of the electrolytic surface graining and the like. In either method, it is important to remove the smut in an amount of from 5 to 70%. The amount of smut generated by the electrolytic surface graining changes in the range of approximately from 0.2 to 5 g/m$^2$ depending on the electrolysis conditions, therefore, the amount of smut removed may be changed within this range according to the objective quality performance.

The thus-obtained aluminum plate is, if desired, treated with an alkali or an acid. An alkali treatment is performed as in JP-A-56-51388 and a desmutting treatment is performed by a sulfuric acid as in JP-A-53-12739. Furthermore, a phosphoric acid treatment described in JP-A-53-115302 and treatments described in JP-A-60-8091, JP-A-63-176188, JP-A-1-38291, JP-A-1-127389, JP-A-1-188699, JP-A-3-177600, JP-A-3-126891 and JP-A-3-191100 may also be used.

After the above-described surface graining or etching by mechanical surface graining, chemical etching or electrochemical surface graining, irregularities are generated. For shaving projections, filiform fibers having a diameter of from 5 to 500 $\mu$m are used. If the diameter is less than 5 $\mu$m, the tips cannot be shaved, whereas if the diameter exceeds 500 $\mu$m, scratches are generated on the surface and use as a lithographic printing plate is not possible any more. The diameter is preferably from 10 to 100 $\mu$m, more preferably from 15 to 50 $\mu$m. The diameter is determined as an average on an enlarged photograph of ten or more projections taken by an SEM photography. The constructive material for the fiber is a chemical fiber such as 6-nylon and 6-10 nylon or an animal hair. For bonding the nylon or the like, a binder such as acryl or NBR is used. In order to improve productivity, the AL plate must be continuously treated and in such a case, the fibers are formed into a roll and rotated at a high speed to shave projections. In the formation into a roll, the roll hardness must be controlled to be 60° or less, because if the hardness on the roll surface is too high, the AI surface is readily scratched. The hardness may be determined according to SRISO101 (Standard of Nippon Rubber Society) or JISS6050. The model of the measuring apparatus is a spring system hardness tester ASKER-C. The peripheral speed of the roll is suitably from 50 to 2,000 m/min. When the roll is rotated while supplying water for the purpose of preventing generation of heat, the shaving may be stably performed.

This step is provided after the surface graining or etching by mechanical surface graining, chemical etching or electrochemical surface graining but may be provided after all steps or after one surface graining or etching step. The timing may be appropriately varied depending on the quality intended.

On the surface of the thus-obtained aluminum support, an anodic oxide film is preferably performed. The anodic oxide film can be formed on the aluminum surface by passing a current through an electrolytic solution comprising an aqueous or non-aqueous solution of a sulfuric acid, a phosphoric acid, a chromic acid, an oxalic acid, a sulfamic acid, a benzenesulfonic acid or a mixture of two or more thereof, using the aluminum as the anode. Conditions for the anodization change variously depending on the electrolytic solution used and cannot be indiscriminately specified, however, in general, the conditions are suitably such that the concentration of electrolytic solution is from 1 to 80 wt %, the liquid temperature is from 5 to 70° C., the current density is from 0.5 to 60 A/cm$^2$, the voltage is from 1 to 100 V, and the electrolysis time is from 15 seconds to 50 minutes. The electrolysis apparatus is described in JP-A-48-26638, JP-A-47-18739 and JP-B-58-24517. Furthermore, the methods described in JP-A-54-81133, JP-A-57-47894, JP-A-57-51289, JP-A-57-51290, JP-A-57-54300, JP-A-57-136596, JP-A-58-107498, JP-A-60-200256, JP-A-62-136596, JP-A-63-176494, JP-A-4-176897, JP-A-4-280997, JP-A-6-207299, JP-A-5-32083, JP-A-5-125597 and JP-A-5-195291 can of course be used. With respect to the treating solution, the solutions described in JP-A-3-253956, JP-A-62-82089, JP-A-1-133794, JP-A-54-32424 and JP-A-5-42783 can be used without any troubles.

After the formation of anodic oxide film as described above, the anodic oxide film is etched and then the AL sheet is subjected to a sealing treatment, so that optimal adhesion can be obtained between the support and the photosensitive composition. An apparatus for the sealing treatment of a support is known (see, JP-B-56-12518), where a photosensitive printing plate having good aging stability, having good developability and being free of scumming on the non-image area can be provided. The sealing treatment after the formation of anodic oxide film may be performed using such an apparatus. Furthermore, the sealing treatment may be performed using the apparatus or method described in JP-A-4-4194, JP-A-5-202496 and JP-A-5-179482.

In addition, the following treatments may be applied: a treatment with potassium fluorozirconate described in U.S. Pat. No. 2,946,638, a treatment with phosphomolybdate described in U.S. Pat. No. 3,201,247, a treatment with alkyl titanate described in British Patent 1,108,559, a treatment with polyacrylic acid described in German Patent 1,091,433, a treatment with polyvinyl phosphonic acid described in German Patent 1,134,093 and British Patent 1,230,447, a treatment with phosphonic acid described in JP-B-44-6409, a treatment with phytic acid, a treatment with a salt of a lipophilic organic polymer compound with a divalent metal described in JP-A-58-16893 and JP-A-58-18291, a technique of providing an undercoat layer of a hydrophilic cellulose (e.g., carboxymethyl cellulose) containing a water-soluble metal salt (e.g., zinc acetate) described in U.S. Pat. No. 3,860,426, a hydrophilizing treatment by the undercoating of a water-soluble polymer having a sulfonic acid group described in JP-A-59-101651, a technique of undercoating a compound such as a phosphate described in JP-A-62-019494, a water-soluble epoxy compound described in JP-A-62-033692, a phosphoric acid-modified starch described in JP-A-62-097892, a diamine compound described in JP-A-63-056498, an inorganic or organic acid of amino acid described in JP-A-63-130391, an organic phosphonic acid containing a carboxyl group or a hydroxyl group described in JP-A-63-145092, a compound having an amino group and a phosphonic acid group described in JP-A-63-165183, a specific carboxylic acid derivative described in JP-A-2-316290, a phosphoric acid ester described in JP-A-1-272594, a compound having one amino group and one oxyacid group, a phosphoric acid ester described in JP-A-3-215095, an aliphatic or aromatic phosphonic acid such as phenylphosphonic acid, a compound containing S atom such as thiosalicylic acid described in JP-A-1-307745 or a compound having an oxyacid group of phosphorus described in JP-A-4-282637, or a technique of coloring by an acidic dye described in JP-A-60-64352. The maximum surface roughness is a value determined in such a manner that a portion just in the standard length is extracted from the sectional curve, two straight lines in parallel to the average line are drawn to sandwich the extracted portion and the distance between these two straight lines is measured in the direction of longitudinal magnification of the sectional curve, and the value is shown by $\mu$m (micrometer).

On the support of the present invention, a photosensitive layer described below by referring to examples thereof is provided to manufacture a photo-sensitive lithographic printing plate.

[1] Case where Photosensitive Layer Containing o-Naphthoquiononediazide Sulfonic Acid Ester and Phenol·Cresol Mixture Novolak Resin The o-quinonediazide compound is an o-naphthoquinonediazide compound and examples thereof are described in a large number of publications including U.S. Pat. Nos. 2,766,118, 2,767,092, 2,772,972, 2,859,112, 3,102,809, 3,106,465, 3,635,709 and 3,647,443. These compounds can be suitably used. Among these, preferred are o-naphthoquinonediazide sulfonic acid ester and o-naphthoquinonediazide carboxylic acid ester of an aromatic hydroxy compound, and o-naphthoquinonediazide sulfonic acid amide and o-naphthoquinonediazide carboxylic acid amide of an aromatic amino compound. In particular, very excellent compounds are an esterification product of a condensate of pyrogallol to acetone with an o-naphthoquinonediazide sulfonic acid described in U.S. Pat. No. 3,635,709, an esterification product of polyester having a hydroxy group at the terminal with o-naphthoquinonediazide sulfonic acid or o-naphthoquinonediazide carboxylic acid described in U.S. Pat. No. 4,028,111, an esterification product of a p-hydroxystyrene homopolymer or a copolymer of p-hydroxystyrene and another monomer copolymerizable therewith, with o-naphthoquinonediazide sulfonic acid or o-naphthoquinonediazide carboxylic acid described in British Patent 1,494,043, and an amidation product of a copolymer of p-aminostyrene and another monomer copolymerizable therewith, with o-naphthoquinonediazide sulfonic acid or o-naphthoquinonediazide carboxylic acid amide described in U.S. Pat. No. 3,759,711.

These o-quinonediazide compounds may be used individually but is preferably used as an admixture with an alkali-soluble resin. Suitable alkali-soluble resins include a novolak-type phenol resin and specific examples thereof include phenolformaldehyde resin, o-cresolformaldehyde resin and m-cresolformaldehyde resin. A combination use of the above-described phenol resin with a condensate of phenol or cresol substituted by an alkyl group having from 3 to 8 carbon atoms to formaldehyde, such as t-butylphenolformaldehyde resin, described in U.S. Pat. No. 4,028,111 is more preferred.

For the formation of a visible image by exposure, a compound such as an inorganic anion salt of o-naphthoquinonediazido-4-sulfonyl chloride or p-diazodiphenylamine, a trihalomethyloxadiazole compound, or a trihalomethyloxadiazole compound having a benzofuran ring is added. As an image coloring agent, triphenylmethane dyes such as Victoria Blue BOH, Crystal Violet and Oil Blue are used. The dyes described in JP-A-62-293247 are more preferred.

Furthermore, the photosensitive layer may contain as an ink receptivity agent-a phenol substituted by an alkyl group having from 3 to 15 carbon atoms described in JP-B-57-23253, such as t-butylphenol, N-octylphenol, novolak resin as a condensate of t-butylphenol to formaldehyde, or an o-naphthoquinonediazido-4- or -5-sulfonic acid ester (those described, for example, in JP-A-61-242446).

In order to attain good developability, the photosensitive layer may also contain a nonionic surface active agent described in JP-A-62-251740.

The above-described composition is coated on a support after dissolving it in a solvent in which respective components can dissolve.

Examples of the solvent used here include ethylene dichloride, cyclohexanone, methyl ethyl ketone, ethylene glycol monomethyl ether, ethylene glycol monoethyl ether, 2-methoxyethyl acetate, 1-methoxy-2-propanol, 1-methoxy-2-propyl acetate, methyl lactate, ethyl lactate, dimethyl sulfoxide, dimethylacetamide, dimethylformamide, water, N-methylpyrrolidone, tetrahydrofurfuryl alcohol, acetone, diacetone alcohol, methanol, ethanol, isopropanol and diethylene glycol dimethyl ether. These solvents are used individually or in combination.

The photosensitive composition comprising these components is provided in an amount, as a solid content, of from 0.5 to 3.0 g/m$^2$.

[2] Case where Photosensitive Layer Containing Diazo Resin and Water-Insoluble and Lipophilic Polymer Compound:

Examples of the diazo resin include a diazo resin inorganic salt as an organic solvent-soluble reaction product of a condensate of p-diazodiphenylamine to formaldehyde or acetaldehyde with hexafluorophosphate or tetrafluorophosphate, and an organic solvent-soluble diazo resin organic acid salt as a reaction product of the above-described condensate with a sulfonic acid such as p-toluene sulfonic acid or a salt thereof, a phosphonic acid such as benzenephosphinic acid or a salt thereof, or a hydroxyl group-containing compound such as 2,4-dihydroxybenzophenone, 2-hydroxy-4-methoxybenzophenone-5-sulfonic acid or a salt thereof described in U.S. Pat. No. 3,300,309.

Another diazo resin which can be suitably used in the present invention is a copolycondensate comprising as constituent units an aromatic compound having at least one organic group selected from a carboxyl group, a sulfonic acid group, a sulfinic acid group, an oxyacid group of phosphorus and a hydroxyl group, and a diazonium compound, preferably an aromatic diazonium compound.

Preferred examples of the aromatic ring include a phenyl group and a naphthyl group.

Examples of the aromatic compound having at least one organic group selected from a carboxyl group, a sulfonic acid group, a sulfinic acid group, an oxyacid group of phosphorus and a hydroxyl group include various compounds and among those, preferred are 4-methoxybenzoic acid, 3-chlorobenzoic acid, 2,4-dimethoxybenzoic acid, p-phenoxybenzoic acid, 4-anilinobenzoic acid, phenoxyacetic acid, phenylacetic acid, p-hydroxybenzoic acid, 2,4-dihydroxy-benzoic acid, benzenesulfonic acid, p-toluenesulfinic acid, 1-naphthalenesulfonic acid, phenylphosphoric acid and phenylphosphonic acid. Examples of the aromatic diazonium compound which can be used as a constituent unit of the copolycondensate diazo resin include diazonium salts described in JP-B-49-48001, with diphenylamine-4-diazonium salts being preferred.

The diphenylamine-4-diazonium salts are derived from 4-amino-diphenylamines and examples of the 4-amine-diphenylamines include 4-aminodiphenylamine, 4-amino-3-methoxydiphenylamine, 4-amino-2-methoxydiphenylamine, 4'-amino-2-methoxydiphenylamine, 4'-amino-4-methoxydiphenylamine, 4-amino-3-methyldiphenylamine, 4-amino-3-ethoxy-diphenylamine, 4-amino-3-β-hydroxyethoxydiphenylamine, 4-aminodiphenylamine-2-sulfonic acid, 4-aminodiphenylamine-2-carboxylic acid and 4-amino-diphenylamine-2'-carboxylic acid, with 4-methoxy-4-amino-4-diphenyl amine and 4-aminodiphenylamine being preferred.

As the diazo resin other than the polycondensate diazo resin with an aromatic compound having an acid group, the diazo resin condensed by an aldehyde having an acid group or an acetal compound thereof described in JP-A-4-18559, JP-A-3-163551 and JP-A-3-253857 may be preferably used.

The counter anion of the diazo resin includes an anion capable of stable forming a salt with the diazo resin and rendering the resin soluble in an organic solvent. The anion includes an organic acid such as decanoic acid and benzoic acid, an organic phosphoric acid such as phenylphosphoric acid, and a sulfonic acid. Typical examples thereof include aliphatic or aromatic sulfonic acids such as methanesulfonic acid, fluoroalkanesulfonic acid (e.g., trifluoromethanesulfonic acid), laurylsulfonic acid, dioctylsulfosuccinic acid, dicyclohexylsulfosuccinic acid, camphorsulfonic acid, trioxy-3-propanesulfonic acid, nonylphenoxy-3-propanesulfonic acid, nonylphenoxy-4-butanesulfonic acid, dibutylphenoxy-3-propanesulfonic acid, diamylphenoxy-3-propanesulfonic acid, dinonylphenoxy-3-propanesulfonic acid, dibutylphenoxy-4-butanesulfonic acid, dinonylphenoxy-4-butanesulfonic acid, benzenesulfonic acid, toluenesulfonic acid, mesitylenesulfonic acid, p-chlorobenzenesulfonic acid, 2,5-dichlorobenenesulfonic acid, sulfosalicylic acid, 2,5-dimethylbenzenesulfonic acid, p-acetylbenzenesulfonic acid, 5-nitro-o-toluenesulfonic acid, 2-nitrobenzenesulfonic acid, 3-chlorobenzenesulfonic acid, 3-bromobenzenesulfonic aid, 2-chloro-5-nitrobenzenesulfonic acid, butylbenzenesulfonic acid, octylbenzenesulfonic acid, decylbenzenesulfonic acid, dodecylbenzenesulfonic acid, butoxybenzenesulfonic acid, dodecyloxybenzenesulfonic acid, 2-hydroxy-4-methoxybenzophenone-5-sulfonic acid, isopropylnaphthalenesulfonic acid, butylnaphthalenesulfonic acid, hexylnaphthalenesulfonic acid, octylnaphthalenesulfonic acid, butoxynaphthalenesulfonic acid, dodecyloxynaphthalenesulfonic acid, dibutylnaphthalenesulfonic acid, dioctylnaphthalenesulfonic acid, triisopropylnaphthalenesulfonic acid, tributylnaphthalenesulfonic acid, 1-naphthol-5-sulfonic acid, naphthalene-1-sulfonic acid, naphthalene-2-sulfonic acid, 1,8-dinitonaphthalene-3,6-disulfonic acid and dimethyl-5-sulfoisophthalate; hydroxy group-containing aromatic compounds such as 2,2',4,4'-tetrahydroxybenzophenone, 1,2,3-trihydroxybenzophenone and 2,2',4-tihydroxybenzophenone; halogenated Lewis acids such as hexafluorophosphoric acid and tetrafluoroboric acid; and perhalogen acids such as $HClO_4$ and $HIO_4$, however, the present invention is by no means limited thereto. Among these, preferred are butylnaphthalenesulfonic acid, dibutylnaphthalenesulfonic acid, hexafluorophosphoric acid, 2-hydroxy-4-methoxybenzophenone-5-sulfonic acid and dodecylbenzenesulfonic acid.

The molecular weight of the diazo resin for use in the present invention may be freely selected by variously changing the molar ratio of respective monomers and the condensation conditions, however, for effectively using the diazo resin to attain the object of the present invention, the resin suitably has a molecular weight of from about 400 to 100,000, preferably from about 800 to 8,000.

Examples of the water-insoluble and lipophilic polymer compound include copolymers usually having a molecular weight of from 1 to 200,000, containing one or more of the following monomers (1) to (15) as the constituent unit:

(1) acrylamides, methacrylamides, acrylic acid esters, methacrylic acid esters and hydroxystyrenes each having an aromatic hydroxyl group, such as N-(4-hydroxyphenyl)-acrylamide, N-(4-hydroxyphenyl)methacrylamide, o-hydroxystyrene, m-hydroxystyrene, p-hydroxystyrene, o-hydroxyphenyl acrylate, m-hydroxyphenyl acrylate, p-hydroxyphenyl acrylate, o-hydroxyphenyl methacrylate, m-hydroxyphenyl methacrylate and p-hydroxyphenyl methacrylate;

(2) acrylic acid esters and methacrylic acid esters each having an aliphatic hydroxyl group, such as 2-hydroxyethyl acrylate, 2-hydroxyethyl methacrylate and 4-hydroxybutyl methacrylate;

(3) unsaturated carboxylic acids such as acrylic acid, methacrylic acid, maleic anhydride and itaconic acid;

(4) (substituted) alkyl acrylates such as methyl acrylate, ethyl acrylate, propyl acrylate, butyl acrylate, amyl acrylate, hexyl acrylate, cyclohexyl acrylate, octyl acrylate, benzyl acrylate, 2-chloroethyl acrylate, glycidyl acrylate and N-dimethylaminoethyl acrylate;

(5) (substituted) alkyl methacrylates such as methyl methacrylate, ethyl methacrylate, propyl methacrylate, butyl methacrylate, amyl methacrylate, cyclohexyl methacrylate, benzyl methacrylate, glycidyl methacrylate and N-dimethylaminoethyl methacrylate;

(6) acrylamides and methacrylamides such as acrylamide, methacrylamide, N-methylolacrylamide, N-methylolmethacrylamide, N-ethylacrylamide, N-hexylmethacrylamide, N-cyclohexylacrylamide, N-hydroxyethylacrylamide, N-phenylacrylamide, N-nitrophenylacrylamide and N-ethyl-N-phenylacrylamide;

(7) vinyl ethers such as ethyl vinyl ether, 2-chloroethyl vinyl ether, hydroxyethyl vinyl ether, propyl vinyl ether, butyl vinyl ether, octyl vinyl ether and phenyl vinyl ether;

(8) vinyl esters such as vinyl acetate, vinyl chloroacetate, vinyl butyrate and vinyl benzoate;

(9) styrenes such as styrene, α-methylstyrene and chloromethylstyrene;

(10) vinyl ketones such as methyl vinyl ketone, ethyl vinyl ketone, propyl vinyl ketone and phenyl vinyl ketone;

(11) olefins such as ethylene, propylene, isobutylene, butadiene and isoprene;

(12) N-vinylpyrrolidone, N-vinylcarbazole, 4-vinylpyridine, acrylonitrile and methacrylonitrile;

(13) unsaturated imides such as maleimide, N-acryloylacrylamide, N-aceketylmethacrylamide, N-propionylmethacrylamide, N-(p-chlorobenzoyl)methacrylamide;

(14) unsaturated sulfonamides including methacrylamides such as N-(o-aminosulfonylphenyl)methacrylamide, N-(m-aminosulfonylphenyl)methacrylamide, N-(p-amino) sulfonylphenylmethacrylamide, N-(1-(3-aminosulfonyl) naphthyl)methacrylamide and N-(2-aminosulfonylethyl) methacrylamide, acrylamides having the same substituents as above, methacrylic acid esters such as o-aminosulfonylphenyl methacrylate, m-aminosulfonylphenyl methacrylate, p-aminosulfonylphenyl methacrylate and 1-(3-aminosulfonylnaphthyl) methacrylate, and acrylic acid esters having the same substituents as above;

(15) unsaturated monomers having a crosslinkable group on the side chain, such as N-(2-(methacryloyloxy)ethyl)-2,3-dimethylmaleimide and vinyl cinnamate, and these monomers copolymerized with a monomer copolymerizable therewith;

(16) phenol resins described in U.S. Pat. No. 3,751,257 and polyvinyl acetal resins such as polyvinyl formal resin and polyvinyl butyral resin; and

(17) polymer compounds resulting from alkali solubilization of polyurethane described in JP-B-54-19773, JP-A-57-904747, JP-A-60-182437, JP-A-62-58242, JP-A-62123452, JP-A-62-123453, JP-A-63-113450 and JP-A-2-146042.

These copolymers may contain, if desired, polyvinyl butyral resin, polyurethane resin, polyamide resin, epoxy resin, novolak resin, natural resin or the like.

The photosensitive composition applied to the support of the present invention may further contain a dye for the purpose of obtaining a visible dye by exposure and a visible dye after development.

Examples of the dye as a discoloring agent for causing change from colored tone to non-colored tone or to different colored tone include triphenylmethane-based, diphenylmethane-based, oxazine-based, xanthene-based, iminonaphthoquinone-based, azomethine-based and anthraquinone-based dyes represented by Victoria Pure Blue BOH (manufactured by Hodogaya Kagaku KK), Oil Blue #603 (produced by Orient Kagaku Kogyo KK), Patent Pure Blue (produced by Sumitomo Mikuni Kagaku KK), Crystal Violet, Brilliant Green, Ethyl Violet, Methyl Violet, Methyl Green, Erythrosine B, Basic Fuchsine, Malachite Green, Oil Red, m-cresol purple, Rhodamine B, Auramine, 4-p-diethylaminophenyliminonaphthoquinone and cyano-p-diethylaminophenylacetanilide.

Examples of the discoloring agent of causing change from non-colored tone to colored tone include primary or secondary arylamine-based dyes represented by triphenylamine, diphenylamine, o-chloroaniline, 1,2,3-triphenylguanidine, naphthylamine, diaminodiphenylmethane, p,p'-bis-dimethylaminodiphenylamine, 1,2-dianilinoethylene, p,p',p"-tris-dimethylaminotriphenylmethane, p,p-bis-dimethylaminodiphenylmethylimine, p,p,p"-triamino-o-methyltriphenylmethane, p,p-bis-dimethylaminodiphenyl-4-anilino-naphthylmethane and p,p,p"-triaminotriphenylmethane. Among these, preferred and effective dyes are triphenylmethane-based and diphenylmethane-based dyes, more preferred are triphenylmethane-based dyes, and still more preferred is Victoria Pure Blue BOH.

The photosensitive composition applied to the support of the present invention may further contain various additives.

Preferred examples thereof include alkyl ethers (for example, ethyl cellulose and methyl cellulose) for improving coatability; fluorine-based surface active agents and nonionic surface active agents (preferably fluorine-based surface active agents); a plasticizer for imparting flexibility and abrasion resistance to the coating (for example, butyl phthalyl, polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate and oligomer or polymer of acrylic acid or methacrylic acid, with tricresyl phosphate being more preferred); an ink receptive agent for improving ink-receptivity of the image area (for example, a half-esterified product of styrene-maleic acid copolymer by alcohol described in JP-A-55-527, a novolak resin such as p-t-butylphenol-formaldehyde resin, and a 50% fatty acid ester of p-hydroxystyrene); a stabilizer (for example, phosphoric acid, phosphorous acid and organic acid (e.g., citric acid, oxalic acid, dipicolinic acid, benzenesulfonic acid, naphthalenesulfonic acid, sulfosalicylic acid, 4-methoxy-2-hydroxybenzophenone-5-sulfonic acid, tartaric acid)); and a development accelerator (for example, higher alcohol and acid anhydride).

The photosensitive composition may be provided on the support by dissolving the photosensitive diazo resin, the liphophilic polymer compound and if desired, various additives, each in a predetermined amount, in an appropriate solvent (e.g., methyl cellosolve, ethyl cellosolve, dimethoxyethane, diethylene glycol monomethyl ether, diethylene glycol dimethyl ether, 1-methoxy-2-propanol, methyl cellosolve acetate, acetone, methyl ethyl ketone, methanol, dimethylformamide, dimethylacetamide, cyclohexanone, dioxane, tetrahydrofurane, methyl lactate, ethyl lactate, ethylene dichloride, dimethyl sulfoxide, water, a mixture thereof) to prepare a coating solution of the photosensitive composition, coating the solution on the support and then drying it.

A sole solvent may be used but a mixture of a high boiling point solvent such as methyl cellosolve, 1-methoxy-2-propanol and methyl lactate with a low boiling point solvent such as methanol and methyl ethyl ketone is preferred.

The photosensitive composition coated preferably has a solid content of from 1 to 50 wt % and to this purpose, the photosensitive composition is coated in an amount of approximately from 0.2 to 10 g/m$^2$.

The amount may be on the order of dry weight. More preferably, the amount coated is from 0.5 to 3 g/m$^2$.

[3] Case where Photosensitive Layer Containing Photodimerization Type Photosensitive Composition and Photopolymerizable Photosensitive Composition:

Examples of the photodimerization type photosensitive composition include polymers having a maleimido group, a cinnamyl group, a cinnamoyl group, a cinnamylidene group, a cynnamylideneacetyl group or a chalcone group on the side chain or main chain. Examples of the polymer having a maleimido group on the side chain include polymers described in JP-A-52-988 (corresponding to U.S. Pat. No. 4,079,041), German Patent 2,626,769, European Patents 21,019 and 3,552, Die Angewandte Makromoleculare Chemie, 115, pp. 163-181 (1983), JP-A-49-128991, JP-A-49-128992, JP-A-49-128993, JP-A-50-5376, JP-A-50-5377, JP-A-50-5379, JP-A-50-5378, JP-A-50-5380, JP-A-53-5298, JP-A-53-5299, JP-A-53-5300, JP-A-50-50107, JP-A-51-47940, JP-A-52-13907, JP-A-50-45076, JP-A-52-121700, JP-A-50-10884, JP-A-50-15087, and German Patents 2,349,948 and 2,616,276.

In order to render such a polymer soluble or swellable in alkali water, it is useful to incorporate a carboxylic acid, a sulfonic acid, a phosphoric acid, a phosphonic acid, an alkali metal salt or ammonium salt thereof, or an acid group having a pKa of from 6 to 12 and dissociative to alkali water. If desired, 13 kinds of the monomers having an acid group may be copolymerized with a monomer having a maleimido group.

The maleimide polymer having an acid group preferably has an acid value of from 30 to 300 and among the polymers having such an acid value, copolymers of N-[2-methacryloyloxy)ethyl]-2,3-dimethylmaleimide with methacrylic or acrylic acid described in Die Angewandte Makromoleculare Chemie, 128, pp. 71-91 (1984) are useful. Furthermore, by copolymerizing a vinyl monomer as the third component in the synthesis of above-described copolymer, a hypercomplex polymer may be easily synthesized according to the purpose. For example, by using an alkyl methacrylate or alkyl acrylate of which homopolymer has a glass transition point of room temperature or less as the third component vinyl monomer, the copolymer obtained can have flexibility.

Examples of the photo-crosslinkable polymer having a cinnamyl group, a cinnamoyl group, a cinnamylidene group, a cinnamylideneacetyl group or a chalcone group on the side or main chain include photosensitive polyesters described in U.S. Pat. No. 3,030,208.

Examples of these photo-crosslinkable polymers solubilized in alkali water include the following compounds.

Photosensitive polymers described in JP-A-60-191244 are included.

Furthermore, photosensitive polymers described in JP-A-62-125729, JP-A-62-175730, JP-A-63-25443, JP-A-63-218944 and JP-A-63-218945 are included.

The photosensitive layer containing these may also contain a sensitizing agent. Examples of the sensitizing agent include benzophenone derivatives, benzanthrone derivatives, quinones, aromatic nitro compounds, naphthothiazoline derivatives, benzothiazoline derivatives, thioxanthone derivatives, naphthothiazole derivatives, ketocoumarin compounds, benzothiazole derivatives, naphthofurane compounds, pyrylium salts and thiapyrylium salts. Furthermore, the photosensitive layer may contain, if desired, a binder such as a copolymer with at least one monomer selected from chlorinated polyethylene, chlorinated polypropylene, polyacrylic acid alkyl ester, acrylic acid alkyl eater, acrylonitrile, vinyl chloride, styrene and butadiene, a polyamide, a methyl cellulose, a polyvinyl formal, a polyvinyl butyral, a methacrylic acid copolymer, an acrylic acid copolymer and an itaconic acid copolymer; and a plasticizer including a phthalic acid dialkyl ester such as dibutyl phthalate, oligoethylene glycol alkyl ester and phosphoric acid ester. In addition, for the purpose of coloring the photosensitive layer, a dye, a pigment or a pH holding agent as a printing-out agent may also be preferably added.

Examples of the photopolymerizable photosensitive composition include an unsaturated carboxylic acid and a salt thereof, esters of an unsaturated carboxylic acid with an aliphatic polyhydric alcohol compound, and amides of an unsaturated carboxylic acid with an aliphatic polyhydric amine compound.

Examples of the photopolymerization initiator include a vic-polytaketardonyl(?) compound, an a-carbonyl compound, an acyloin ether, a combination of triallylimidazole dimer/p-aminophenyl ketone, a benzothiazole-based compound, a trihalomethyl-s-triazine compound, acridine and phenanzine compounds, and an oxadiazole compound. Examples of the high molecular polymer which is soluble or swellable in alkali water together with the photopolymerization initiator and capable of forming a film include a benzyl (meth)acrylate/(meth)acrylic acid/another addition polymerizable vinyl monomer, if desired, copolymer, a methacrylic acid/methyl methacrylate (or methacrylic acid ester) copolymer, a maleic anhydride copolymer added by half-esterification with pentaerythritol triacrylate, and an acidic vinyl copolymer.

[4] Photosensitive Layer for Electrophotography

A ZnO photosensitive layer disclosed, for example, in U.S. Pat. No. 3,001,782 may be used. Furthermore, a photosensitive layer using an electrophotographic photoreceptor described in JP-A-56-161550, JP-A-60-186847 and JP-A-61-238063 may also be used.

The amount of the photosensitive layer provided on the support is from about 0.1 to about 7 g/m$^2$, preferably from 0.5 to 4 g/m$^2$, in terms of dry weight after the coating.

In the production method of a support for a lithographic printing plate according to the present invention, an interlayer may be provided, if desired, so as to increase the adhesion between the support and the photosensitive layer, not to allow the photosensitive layer to remain after development or to prevent halation.

The interlayer provided for the purpose of increasing adhesion generally comprises a diazo resin, a phosphoric acid capable of adsorbing, for example, to aluminum, an amino compound or a carboxylic acid compound. The interlayer comprising a substance having high solubility so as not to allow the photosensitive layer to remain after development generally comprises a polymer having good solubility or a water-soluble polymer. The interlayer provided so as to prevent halation generally contains a dye or a UV absorbent. The interlayer may have any thickness but the thickness must be large enough to allow the reaction for forming uniform bonding with the photosensitive layer as an upper layer to proceed at the time of exposure. The coating ratio as a dry solid is usually from about 1 to 100 mg/m$^2$, preferably from 5 to 40 mg/m$^2$.

On the photosensitive layer coated, a matting layer constituted by projections provided independently from each other may also be provided.

The matting layer is provided for the purpose of improving the vacuum adhesion between a negative image film and a photosensitive lithographic printing plate at the contact exposure, thereby reducing the vacuumization time and further preventing plugging of fine halftone dots due to contact failure at the exposure time.

The method for coating the matting layer includes a method of powdering a polymer and adhering it by thermal fusion described in JP-A-55-12974 and a method of spraying and then drying a polymer-containing water described in JP-A-58-182636. Either method may be used but a method where the matting layer itself can be dissolved in or removed by an aqueous alkali developer substantially free of an organic solvent is preferred.

The thus-manufactured photosensitive lithographic printing plate is imagewise exposed and then subjected to processing including development in usual manner to form a resin image. For example, in the case of a photosensitive lithographic printing plate having a photosensitive layer of [1] above, development with an aqueous alkali solution described in U.S. Pat. No. 4,259,434 is performed after exposure to remove the exposed area and thereby obtain a lithographic printing plate. In the case of a photosensitive lithographic printing plate having a photosensitive layer of [2] above, development with a developer described in U.S. Pat. No. 4,186,006 is performed after imagewise exposure to remove the photosensitive layer at the unexposed area and thereby obtain a lithographic printing plate. Also, an aqueous alkali developer composition used in the development of a positive lithographic printing plate described in JP-A-59-84241, JP-A-57-192952 and JP-A-62-24263 may be used.

EXAMPLES

The present invention is described below in greater detail by referring to the Examples.

Example 1

An aluminum plate according to JIS A 1050 having a thickness of 0.24 mm and a width of 1,030 mm, produced by a DC casting method where intermediate annealing and soaking were omitted, was chemically etched in an aqueous acid or alkali solution to be prone to appearance of streaks and grainy unevenness and then continuously treated.

This aluminum plate contained impurity trace components in such a proportion that Si was 0.15 wt %, Fe was 0.28%, Cu was 0.019 wt %, Ti was 0.03 wt %, Mn was 0.02 wt %, Mg was 0.023 wt % and Zn was 0.02 wt %.

(1) Mechanical Surface Graining

While supplying a suspension of quartz sand having a specific gravity of 1.12 and water as an abrasive slurry solution onto the surface of the aluminum plate, the mechanical surface graining was performed using rotating roller-form nylon brushes. The constructive material of the nylon brush used was 6·10 nylon, the hair length was 50 mm and the hair diameter was 0.48 mm. The nylon brush hairs were implanted densely into holes bored on a 300 mmϕ stainless steel-made tube. Three rotary brushes were used. The distance between two supporting rollers (ϕ200 mm) disposed at the lower part of brushes was 300 mm. The brush rollers were pressed until the load of a driving motor for rotating the brushes reached (the load before the pressing of brush rollers onto the aluminum plate)+6 kw. The rotating direction of brushes was the same as the moving direction of the aluminum plate. Thereafter, the aluminum plate was washed with water. The moving rate of the aluminum plate was 50 m/min.

(2) Etching in Aqueous Alkali Solution

The aluminum plate was etched by immersing it in an aqueous solution containing 27 wt % of NaOH and 6.5 wt % of aluminum ion at 70° C. The amount of the aluminum plate dissolved was 10 g/m$^2$. Thereafter, the aluminum plate was washed with water.

(3) Desmutting

Next, the aluminum plate was desmutted by immersing it in an aqueous solution containing 1 wt % of hydrochloric acid at 35° C. for 10 seconds. Thereafter, the aluminum plate was washed with water.

(4) Preliminary Electrochemical Surface Graining in Aqueous Hydrochloric Acid Solution Using the AC voltage of FIG. 1 and one tank of the apparatus of FIG. 2, continuous electrochemical surface graining was performed. At this time, the electrolytic solution was an aqueous solution containing 1 wt % of hydrochloric acid (containing 0.5 wt % of aluminum ion) and the liquid temperature was 35° C. In this electrochemical surface graining, the AC power waveform used was a trapezoidal rectangular wave AC of 60 Hz such that the time TP until the current value starting from zero reached the peak was 1 msec and the duty ratio was 1:1, and a carbon electrode was used as the counter electrode. The auxiliary anode used was ferrite.

The current density was 50 A/dm$^2$ in terms of the current peak value and the quantity of electricity was 40 C/dm$^2$ in terms of the total electricity quantity when the aluminum plate was at the anode time. Into the auxiliary anode, 5% of the current flowing from the power source was split. Thereafter, the aluminum plate was washed with water by a spray.

(5) Etching in Aqueous Alkali Solution

The aluminum plate was etched by immersing it in an aqueous solution containing 27 wt % of NaOH and 6.5 wt % of aluminum ion at 70° C. The amount of the aluminum plate dissolved was 0.3 g/m$^2$. Thereafter, the aluminum plate was washed with water.

(6) Desmutting

Then, the aluminum plate was desmutted by immersing it in an aqueous solution containing 1 wt % of nitric acid (containing 0.5 wt % of aluminum ion and 0.007 wt % of ammonium ion) at 35° C. for 10 seconds. Thereafter, the aluminum plate was washed with water.

(7) Electrochemical Surface Graining in Aqueous Nitric Acid Solution

Using the AC voltage of FIG. 1 and one tank of the apparatus of FIG. 2, continuous electrochemical surface graining was performed. At this time, the electrolytic solution was an aqueous solution containing 1 wt % of nitric acid (containing 0.5 wt % of aluminum ion and 0.007 wt % of ammonium ion) and the liquid temperature was 70° C. In this electrochemical surface graining, the AC power waveform used was a trapezoidal rectangular wave AC of 60 Hz such that the time TP until the current value starting from zero reached the peak was 1 msec and the duty ratio was 1:1, and a carbon electrode was used as the counter electrode. The auxiliary anode used was ferrite.

The current density was 50 A/dm$^2$ in terms of the current peak value and the quantity of electricity was 125 C/dm$^2$ in terms of the total electricity quantity when the aluminum plate was at the anode time. Into the auxiliary anode, 5% of the current flowing from the power source was split. Thereafter, the aluminum plate was water washed by a spray.

(8) Etching in Aqueous Alkali Solution

The aluminum plate was etched by immersing it in an aqueous solution containing 26 wt % of NaOH and 6.5 wt % of aluminum ion at 45° C. The amount of the aluminum plate dissolved was 1 g/m$^2$. Thereafter, the aluminum plate was washed with water.

(9) Desmutting

The aluminum plate was washed with water and then desmutted by immersing it in an aqueous solution containing 25 wt % of sulfuric acid at 60° C. Thereafter, the aluminum plate was washed with water.

(10) Polishing

Using four rollers each having a diameter of 300 mm and constructed by a nylon non-woven fabric, the polishing was performed while rotating the rollers at 1,000 rpm. During the polishing, a 1 wt % of caustic soda (containing 0.1% of aluminum ion) at 30° C. was sprayed between the aluminum plate and the nylon non-woven fabric roller. At this time, the amount of aluminum dissolved was 0.1 g/m$^2$. Thereafter, the aluminum plate was washed with water and further desmutted in an aqueous solution containing 15 wt % of sulfuric acid (containing 0.5 wt % of aluminum ion).

(11) Anodization

Anodization was performed in an aqueous solution having a sulfuric acid concentration of 15 wt % (containing 0.5 wt % of aluminum ion) at a liquid temperature of 35° C. using a DC voltage at a current density of 2 A/dm$^2$ such that the amount of the anodic oxide film formed was 2.4 g/m$^2$. Thereafter, the aluminum plate was water washed by a spray.

On the surface of the aluminum plate obtained, no appearance of streaks and grainy unevenness ascribable to the orientation of the crystal grain was shown.

On the aluminum plate, an interlayer and a photosensitive layer were coated and dried to prepare a positive PS plate having a dry thickness of 2.0 g/m$^2$. Printing was performed using this PS plate, as a result, the plate was verified to be a good printing plate.

This lithographic printing plate was used in a proof printing machine and then verified to be a good printing plate free of catching up of a sponge at the time when an operator supplied fountain solution by the sponge, and prevented from easy generation of sponge debris. Furthermore, because of no appearance of streaks and grainy unevenness, the aluminum plate surface was free of unevenness, therefore, the suitability for plate inspection was high.

When this support was observed through a scanning type electron microscope, about 25% of large wave projections were roundly worked.

Example 2

The aluminum substrate after the anodization in Example 1 was hydrophilized by immersing it in an aqueous solution at 70° C. containing 2.5 wt % of sodium silicate for 14 seconds. Then, the substrate was water washed by a spray and dried. After each treatment and water washing, the liquid squeezing by nip rollers was performed.

On the thus-treated aluminum plate, an interlayer and a negative photosensitive layer were coated and dried to prepare a PS plate. Using this PS plate, printing was performed, as a result, the plate was verified to be a good printing plate.

Example 3

An aluminum substrate was surface grained thoroughly in the same manner as in Example 1 except that (8) the chemical etching in an aqueous alkali solution of Example 1 was replaced by anodization in an aqueous solution containing 9 wt % of caustic soda and 0.5 wt % of aluminum ion at 35° C. in a current density of 20 A/dm$^2$ using the aluminum plate as the anode such that the amount of aluminum dissolved was 1 g/m$^2$. On the thus-treated aluminum plate, an interlayer and a negative photosensitive layer were coated and dried to prepare a PS plate. Using this PS plate, printing was performed, as a result, the plate was verified to be a good printing plate.

Example 4

The aluminum substrate after the anodization in Example 3 was hydrophilized by immersing it in an aqueous solution at 70° C. containing 2.5 wt % of sodium silicate for 14 seconds. Then, the substrate was water washed by a spray and dried. After each treatment and water washing, the liquid squeezing by nip rollers was performed.

On the thus-treated aluminum plate, an interlayer and a negative photosensitive layer were coated and dried to prepare a PS plate. Using this PS plate, printing was performed, as a result, the plate was verified to be a good printing plate.

Example 5

An aluminum substrate was surface grained thoroughly in the same manner as in Example 1 except for using water and an abrasive having an average particle size of 0.05 $\mu$m in (10) the polishing of Example 1. On the thus-treated aluminum plate, an interlayer and a positive photosensitive layer were coated and dried to prepare a PS plate. Using this PS plate, printing was performed, as a result, the plate was verified to be a good printing plate.

Example 6

An aluminum plate according to JIS A 1050 having a thickness of 0.24 mm and a width of 1,030 mm, produced by a DC casting method where intermediate annealing and soaking were omitted, was chemically etched in an aqueous acid or alkali solution to be prone to appearance of streaks and grainy unevenness and then continuously treated.

This aluminum plate contained impurity trace components in such a proportion that Si was 0.06 wt %, Fe was 0.1%, Cu was 0.01 wt %, Ti was 0.02 wt %, Mn was 0.01 wt %, Mg was 0.01 wt % and Zn was 0.01 wt %.

The aluminum plate was surface grained in the same manner as in Example 1.

(1) Etching in Aqueous Alkali Solution

The aluminum plate was etched by immersing it in an aqueous solution containing 27 wt % of NaOH and 6.5 wt % of aluminum ion at 70° C. The amount of the aluminum plate dissolved was 2 g/m$^2$. Thereafter, the aluminum plate was washed with water.

(2) Desmutting

Next, the aluminum plate was desmutted by immersing it in an aqueous solution containing 1 wt % of hydrochloric acid at 35° C. for 10 seconds. Thereafter, the aluminum plate was washed with water.

(3) Electrochemical Surface Graining in Aqueous Hydrochloric Acid Solution

Using the AC voltage of FIG. 1 and two baths of the apparatus of FIG. 2, continuous electrochemical surface graining was performed. At this time, the electrolytic solution was a hydrochloric acid 1 wt % aqueous solution (containing 0.5 wt % of aluminum ion) and the liquid temperature was 35° C. In this electrochemical surface graining, the AC power waveform used was a trapezoidal rectangular wave AC of 60 Hz such that the time TP until the current value starting from zero reached the peak was 1 msec and the duty ratio was 1:1, and a carbon electrode was used as the counter electrode. The auxiliary anode used was ferrite.

The current density was 50 A/dm$^2$ in terms of the current peak value and the quantity of electricity was 400 C/dm$^2$ in terms of the total electricity quantity when the aluminum plate was at the anode time. Into the auxiliary anode, 5% of the current flowing from the power source was split. Thereafter, the aluminum plate was water washed by a spray.

(4) Etching in Aqueous Alkali Solution

The aluminum plate was etched by immersing it in an aqueous solution containing 26 wt % of NaOH and 6.5 wt % of aluminum ion at 45° C. The amount of the aluminum plate dissolved was 0.3 g/m$^2$. Thereafter, the aluminum plate was washed with water.

(5) Desmutting

The aluminum plate was washed with water and then desmutted by immersing it in an aqueous solution containing 25 wt % of sulfuric acid at 60° C. Thereafter, the aluminum plate was washed with water.

(6) Polishing

Using four rollers each having a diameter of 300 mm and constructed by a nylon non-woven fabric, the polishing was performed while rotating the rollers at 300 rpm. During the polishing, water was sprayed between the aluminum plate and the nylon non-woven fabric roller. At this time, the amount of aluminum dissolved was 0.1 g/m$^2$. Thereafter, the aluminum plate was washed with water and then again desmutted in an aqueous solution containing 15 wt % of sulfuric acid (containing 0.5 wt % of aluminum ion). The rollers used for the polishing were disposed to rotate normally, normally, reversely and reversely in sequence with respect to the direction of the aluminum plate proceeding.

(7) Anodization

Anodization was performed in an aqueous solution having a sulfuric acid concentration of 15 wt % (containing 0.5 wt % of aluminum ion) at a liquid temperature of 35° C. using a DC voltage at a current density of 2 A/dm$^2$ such that the amount of the anodic oxide film formed was 2.4 g/m$^2$. Thereafter, the aluminum plate was water washed by a spray.

On the surface of the aluminum plate obtained, no appearance of streaks and grainy unevenness ascribable to the orientation of the crystal grain was shown.

On the aluminum plate, an interlayer and a photosensitive layer were coated and dried to prepare a positive PS plate having a dry thickness of 2.0 g/m$^2$. Printing was performed using this PS plate, as a result, the plate was verified to be a good printing plate.

This lithographic printing plate was used in a proof printing machine and then verified to be a good printing plate free of catching up of a sponge at the time when an operator supplied fountain solution by the sponge, and prevented from easy generation of sponge debris. Furthermore, because of no appearance of streaks and grainy unevenness, the aluminum plate surface was free of unevenness, therefore, the suitability for plate inspection was high.

Example 7

An aluminum plate was surface grained thoroughly in the same manner as in Example 6 except that the treatments (1), (2) and (3) of Example 6 were replaced by the following treatments.

(1) Etching in Aqueous Alkali Solution

The aluminum plate was etched by immersing it in an aqueous solution containing 27 wt % of NaOH and 6.5 wt % of aluminum ion at 70° C. The amount of the aluminum plate dissolved was 8 g/m$^2$. Thereafter, the aluminum plate was washed with water.

(2) Desmutting

Next, the aluminum plate was desmutted by immersing it in an aqueous solution containing 1 wt % of nitric acid at 35° C. for 10 seconds. Thereafter, the aluminum plate was washed with water.

(3) Electrochemical Surface Graining in Aqueous Nitric Acid Solution

Using the AC voltage of FIG. 1 and two baths of the apparatus of FIG. 2, continuous electrochemical surface graining was performed. At this time, the electrolytic solution was an aqueous solution containing 1 wt % of nitric acid (containing 0.5 wt % of aluminum ion) and the liquid temperature was 50° C. In this electrochemical surface graining, the AC power waveform used was a trapezoidal rectangular wave AC of 60 Hz such that the time TP until the current value starting from zero reached the peak was 1 msec and the duty ratio was 1:1, and a carbon electrode was used as the counter electrode. The auxiliary anode used was ferrite.

The current density was 50 A/dm$^2$ in terms of the current peak value and the quantity of electricity was 250 C/dm$^2$ in terms of the total electricity quantity when the aluminum plate was at the anode time. Into the auxiliary anode, 5% of the current flowing from the power source was split. Thereafter, the aluminum plate was water washed by a spray.

On the surface of the aluminum plate obtained, no appearance of streaks and grainy unevenness ascribable to the orientation of the crystal grain was shown.

On the aluminum plate, an interlayer and a photosensitive layer were coated and dried to prepare a positive PS plate having a dry thickness of 2.0 g/m$^2$. Printing was performed using this PS plate, as a result, the plate was verified to be a good printing plate.

This lithographic printing plate was used in a proof printing machine and then verified to be a good printing plate free of catching up of a sponge at the time when an operator supplied fountain solution by the sponge, and prevented from easy generation of sponge debris. Furthermore, because of no appearance of streaks and grainy unevenness, the aluminum plate surface was free of unevenness, therefore, the suitability for plate inspection was high.

Example 8

An aluminum plate according to JIS A 1050 having a thickness of 0.24 mm and a width of 1,030 mm, produced by a DC casting method where intermediate annealing and soaking were omitted, was chemically etched in an aqueous acid or alkali solution to be prone to appearance of streaks and grainy unevenness and then continuously treated.

This aluminum plate contained impurity trace components in such a proportion that Si was 0.15 wt %, Fe was 0.28%, Cu was 0.019 wt %, Ti was 0.03 wt %, Mn was 0.02 wt %, Mg was 0.023 wt % and Zn was 0.02 wt %.

(1) Mechanical Surface Graining

While supplying a suspension of quartz sand having a specific gravity of 1.12 and water as an abrasive slurry solution onto the surface of the aluminum plate, the mechanical surface graining was performed using rotating roller-form nylon brushes. The constructive material of the nylon brush used was 6·10 nylon, the hair length was 50 mm and the hair diameter was 0.48 mm. The nylon brush hairs were implanted densely into holes bored on a 300 mmϕ stainless steel-made tube. Three rotary brushes were used. The distance between two supporting rollers (ϕ200 mm) disposed at the lower part of brushes was 300 mm. The brush rollers were pressed until the load of a driving motor for rotating the brushes reached (the load before the pressing of brush rollers onto the aluminum plate)+6 kw. The rotating direction of brushes was the same as the moving direction of the aluminum plate. Thereafter, the aluminum plate was washed with water. The moving rate of the aluminum plate was 50 m/min.

(2) Etching in Aqueous Alkali Solution

The aluminum plate was etched by immersing it in an aqueous solution containing 27 wt % of NaOH and 6.5 wt % of aluminum ion at 70° C. The amount of the aluminum plate dissolved was 2 g/m$^2$. Thereafter, the aluminum plate was washed with water.

(3) Desmutting

Next, the aluminum plate was washed with water and then desmutted by immersing it in an aqueous solution containing 15 wt % of sulfuric acid (containing 0.5 wt % of aluminum ion) at 35° C. Thereafter, the aluminum plate was washed with water.

(4) Polishing

Using four rollers each having a diameter of 300 mm and constructed by a nylon non-woven fabric, the polishing was performed while rotating the rollers at 2,000 rpm. During the polishing, water was sprayed between the aluminum plate and the nylon non-woven fabric roller. Thereafter, the aluminum plate was washed with water.

(5) Anodization

Anodization was performed in an aqueous solution having a sulfuric acid concentration of 15 wt % (containing 0.5 wt % of aluminum ion) at a liquid temperature of 35° C. using a DC voltage at a current density of 2 A/dm$^2$ such that the amount of the anodic oxide film formed was 2.4 g/m$^2$. Thereafter, the aluminum plate was water washed by a spray.

On the surface of the aluminum plate obtained, no appearance of streaks and grainy unevenness ascribable to the orientation of the crystal grain was shown. On the aluminum plate, an interlayer and a photosensitive layer were coated and dried to prepare a positive PS plate having a dry thickness of 2.0 g/m$^2$. Printing was performed using this PS plate, as a result, the plate was verified to be a good printing plate.

This lithographic printing plate was used in a proof printing machine and then verified to be a good printing plate free of catching up of a sponge at the time when an operator supplied fountain solution by the sponge, and prevented from easy generation of sponge debris. Furthermore, because of no appearance of streaks and grainy unevenness, the aluminum plate surface was free of unevenness, therefore, the suitability for plate inspection was high.

An aluminum plate according to JIS A 1050 having a thickness of 0.24 mm and a width of 1,030 mm, produced by a DC casting method where intermediate annealing and soaking were omitted, was chemically etched in an aqueous acid or alkali solution to be prone to appearance of streaks and grainy unevenness and then continuously treated.

This aluminum plate contained impurity trace components in such a proportion that Si was 0.15 wt %, Fe was 0.28%, Cu was 0.019 wt %, Ti was 0.03 wt %, Mn was 0.02 wt %, Mg was 0.023 wt % and Zn was 0.02 wt %.

Example 9

An aluminum plate the same as in Example 8 was continuously treated.

(1) Mechanical Surface Graining

While supplying a suspension of quartz sand having a specific gravity of 1.12 and water as an abrasive slurry solution onto the surface of the aluminum plate, the mechanical surface graining was performed using rotating roller-form nylon brushes. The constructive material of the nylon brush used was 6·10 nylon, the hair length was 50 mm and the hair diameter was 0.48 mm. The nylon brush hairs were implanted densely into holes bored on a 300 mmϕ stainless steel-made tube. Three rotary brushes were used. The distance between two supporting rollers (ϕ200 mm) disposed at the lower part of brushes was 300 mm. The brush rollers were pressed until the load of a driving motor for rotating the brushes reached (the load before the pressing of brush rollers onto the aluminum plate)+6 kw. The rotating direction of brushes was the same as the moving direction of the aluminum plate. Thereafter, the aluminum plate was washed with water. The moving rate of the aluminum plate was 50 m/min.

(2) Etching in Aqueous Alkali Solution

The aluminum plate was etched by immersing it in an aqueous solution containing 27 wt % of NaOH and 6.5 wt % of aluminum ion at 70° C. The amount of the aluminum plate dissolved was 10 g/m$^2$. Thereafter, the aluminum plate was washed with water.

(3) Desmutting

Next, the aluminum plate was desmutted by immersing it in an aqueous solution containing 1 wt % of nitric acid (containing 0.5 wt % of aluminum ion and 0.007 wt % of ammonium ion) at 35° C. for 10 seconds. Thereafter, the aluminum plate was washed with water.

(4) Electrochemical Surface Graining in Aqueous Nitric Acid Solution

Using the AC voltage of FIG. 1 and two baths of the apparatus of FIG. 2, continuous electrochemical surface graining was performed. At this time, the electrolytic solution was an aqueous solution containing 1 wt % of nitric acid (containing 0.5 wt % of aluminum ion and 0.007 wt % of ammonium ion) and the liquid temperature was 50° C. In this electrochemical surface graining, the AC power waveform used was a trapezoidal rectangular wave AC of 60 Hz such that the time TP until the current value starting from zero reached the peak was 1 msec and the duty ratio was 1:1, and a carbon electrode was used as the counter electrode. The auxiliary anode used was ferrite. The current density was 50 A/dm$^2$ in terms of the current peak value and the quantity of electricity was 230 C/dm$^2$ in terms of the total electricity quantity when the aluminum plate was at the anode time. Into the auxiliary anode, 5% of the current flowing from the power source was split. Thereafter, the aluminum plate was washed with water by a spray.

(5) Etching in Aqueous Alkali Solution

The aluminum plate was etched by immersing it in an aqueous solution containing 26 wt % of NaOH and 6.5 wt % of aluminum ion at 45° C. The amount of the aluminum plate dissolved was 1 g/m$^2$. Thereafter, the aluminum plate was washed with water.

(6) Desmutting

The aluminum plate was washed with water and then desmutted by immersing it in an aqueous solution containing 25 wt % of sulfuric acid at 60° C. Thereafter, the aluminum plate was washed with water.

(7) Polishing

Using three nylon non-woven fabric rollers each having a diameter of 300 mm and constructed by a nylon non-woven fabric, the polishing was performed while rotating the rollers at 1,000 rpm. During the polishing, water was sprayed between the aluminum plate and the nylon non-woven fabric roller.

(8) Anodization

Anodization was performed in an aqueous solution having a sulfuric acid concentration of 15 wt % (containing 0.5 wt % of aluminum ion) at a liquid temperature of 35° C. using a DC voltage at a current density of 2 A/dm$^2$ such that the amount of the anodic oxide film formed was 2.4 g/m$^2$. Thereafter, the aluminum plate was water washed by a spray.

On the surface of the aluminum plate obtained, no appearance of streaks and grainy unevenness ascribable to the orientation of the crystal grain was shown.

On the aluminum plate, an interlayer and a photosensitive layer were coated and dried to prepare a positive PS plate having a dry thickness of 2.0 g/m$^2$. Printing was performed using this PS plate, as a result, the plate was verified to be a good printing plate.

This lithographic printing plate was used in a proof printing machine and then verified to be a good printing plate free of catching up of a sponge at the time when an operator supplied fountain solution by the sponge, and prevented from easy generation of sponge debris. Furthermore, because of no appearance of streaks and grainy unevenness, the aluminum plate surface was free of unevenness, therefore, the suitability for plate inspection was high.

Example 10

An aluminum plate according to JIS A 1050 having a thickness of 0.24 mm and a width of 1,030 mm, produced by a DC casting method where intermediate annealing and soaking were omitted, was chemically etched in an aqueous acid or alkali solution to be prone to appearance of streaks and grainy unevenness and then continuously treated.

This aluminum plate contained impurity trace components in such a proportion that Si was 0.15 wt %, Fe was 0.28%, Cu was 0.019 wt %, Ti was 0.03 wt %, Mn was 0.02 wt %, Mg was 0.023 wt % and Zn was 0.02 wt %.

(1) Polishing

Using four rollers each having a diameter of 300 mm and constructed by a nylon non-woven fabric, the polishing was performed while rotating the rollers at 1,000 rpm. During the polishing, water was sprayed between the aluminum plate and the nylon non-woven fabric roller.

(2) Mechanical Surface Graining

While supplying a suspension of quartz sand having a specific gravity of 1.12 and water as an abrasive slurry solution onto the surface of the aluminum plate, the mechanical surface graining was performed using rotating roller-form nylon brushes. The constructive material of the nylon brush used was 6·10 nylon, the hair length was 50 mm and the hair diameter was 0.48 mm. The nylon brush hairs were implanted densely into holes bored on a stainless steel-made tube having a diameter of 300 mm. Three rotary brushes were used. The distance between two supporting rollers (diameter: 200 mm) disposed at the lower part of brushes was 300 mm. The brush rollers were pressed until the load of a driving motor for rotating the brushes reached (the load before the pressing of brush rollers onto the aluminum plate)+6 kw. The rotating direction of brushes was the same as the moving direction of the aluminum plate. Thereafter, the aluminum plate was washed with water. The moving rate of the aluminum plate was 50 m/min.

(3) Etching in Aqueous Alkali Solution

The aluminum plate was etched by immersing it in an aqueous solution containing 27 wt % of NaOH and 6.5 wt % of aluminum ion at 70° C. The amount of the aluminum plate dissolved was 10 g/m$^2$. Thereafter, the aluminum plate was washed with water.

(4) Desmutting

Next, the aluminum plate was desmutted by immersing it in an aqueous solution containing 1 wt % of hydrochloric acid at 35° C. for 10 seconds. Thereafter, the aluminum plate was washed with water.

(5) Preliminary Electrochemical Surface Graining in Aqueous Hydrochloric Acid Solution Using the AC voltage of FIG. 1 and the apparatus of FIG. 2, continuous electrochemical surface graining was performed. At this time, the electrolytic solution was an aqueous solution containing 1 wt % of hydrochloric acid (containing 0.5 wt % of aluminum ion) and the liquid temperature was 35° C. In this electrochemical surface graining, the AC power waveform used was a trapezoidal rectangular wave AC of 60 Hz such that the time TP until the current value starting from zero reached the peak was 1 msec and the duty ratio was 1:1, and a carbon electrode was used as the counter electrode. The auxiliary anode used was ferrite.

The current density was 50 A/dm$^2$ in terms of the current peak value and the quantity of electricity was 40 C/dm$^2$ in terms of the total electricity quantity when the aluminum plate was at the anode time. Into the auxiliary anode, 5% of the current flowing from the power source was split. Thereafter, the aluminum plate was washed with water by a spray.

(6) Etching in Aqueous Alkali Solution

The aluminum plate was etched by immersing it in an aqueous solution containing 27 wt % of NaOH and 6.5 wt % of aluminum ion at 70° C. The amount of the aluminum plate dissolved was 0.3 g/M$^2$. Thereafter, the aluminum plate was washed with water.

(7) Desmutting

Then, the aluminum plate was desmutted by immersing it in an aqueous solution containing 1 wt % of nitric acid (containing 0.5 wt % of aluminum ion and 0.007 wt % of ammonium ion) at 35° C. for 10 seconds. Thereafter, the aluminum plate was washed with water.

(8) Electrochemical Surface Graining in Aqueous Nitric Acid Solution

Using the AC voltage of FIG. 1 and two baths of the apparatus of FIG. 2, continuous electrochemical surface graining was performed. At this time, the electrolytic solution was an aqueous solution containing 1 wt % of nitric acid (containing 0.5 wt % of aluminum ion and 0.007 wt % of ammonium ion) and the liquid temperature was 50° C. In this electrochemical surface graining, the AC power waveform used was a trapezoidal rectangular wave AC of 60 Hz such that the time TP until the current value starting from zero reached the peak was 1 msec and the duty ratio was 1:1, and a carbon electrode was used as the counter electrode. The auxiliary anode used was ferrite. The current density was 50 A/dm$^2$ in terms of the current peak value and the quantity of electricity was 190 C/dm$^2$ in terms of the total electricity quantity when the aluminum plate was at the anode time. Into the auxiliary anode, 5% of the current flowing from the power source was split. Thereafter, the aluminum plate was water washed by a spray.

(9) Etching in Aqueous Alkali Solution

The aluminum plate was etched by immersing it in an aqueous solution containing 26 wt % of NaOH and 6.5 wt % of aluminum ion at 45° C. The amount of the aluminum plate dissolved was 0.7 g/m$^2$. Thereafter, the aluminum plate was washed with water.

(10) Desmutting

The aluminum plate was washed with water and then desmutted by immersing it in an aqueous solution containing 25 wt % of sulfuric acid at 60° C. Thereafter, the aluminum plate was washed with water.

(11) Polishing

Using four rollers each having a diameter of 300 mm and constructed by a nylon non-woven fabric, the polishing was performed while rotating the rollers at 1,000 rpm. During the polishing, water was sprayed between the aluminum plate and the nylon non-woven fabric roller.

(12) Anodization

Anodization was performed in an aqueous solution having a sulfuric acid concentration of 15 wt % (containing 0.5 wt % of aluminum ion) at a liquid temperature of 35° C. using a DC voltage at a current density of 2 A/dm$^2$ such that the amount of the anodic oxide film formed was 2.4 g/m$^2$. Thereafter, the aluminum plate was water washed by a spray.

On the surface of the aluminum plate obtained, no appearance of streaks and grainy unevenness ascribable to the orientation of the crystal grain was shown.

On the aluminum plate, an interlayer and a photosensitive layer were coated and dried to prepare a positive PS plate having a dry thickness of 2.0 g/m$^2$. Printing was performed using this PS plate, as a result, the plate was verified to be a good printing plate.

This lithographic printing plate was used in a proof printing machine and then verified to be a good printing plate free of catching up of a sponge at the time when an operator supplied fountain solution by the sponge, and prevented from easy generation of sponge debris. Furthermore, because of no appearance of streaks and grainy unevenness, the aluminum plate surface was free of unevenness, therefore, the suitability for plate inspection was high.

When this support was observed through a scanning type electron microscope, about 25% of large wave projections were roundly worked.

Example 11

The substrate after anodization of Example 10 was hydrophilized by immersing it in an aqueous solution containing 25 wt % of sodium silicate at 70° C. for 14 seconds. Thereafter, the aluminum plate was washed with water and then dried. After each treatment and water washing, liquid squeezing by nip rollers was performed.

On the thus-treated aluminum plate, an interlayer and a negative photosensitive layer were coated and dried to prepare a PS plate. Printing was performed using this PS plate, as a result, the plate was verified to be a good printing plate.

Example 12

An aluminum plate according to JIS A 1050 having a thickness of 0.24 mm and a width of 1,030 mm, produced by a DC casting method where intermediate annealing and soaking were omitted, was chemically etched in an aqueous acid or alkali solution to be prone to appearance of streaks and grainy unevenness and then continuously treated.

This aluminum plate contained impurity trace components in such a proportion that Si was 0.06 wt %, Fe was 0.1%, Cu was 0.01 wt %, Ti was 0.02 wt %, Mn was 0.01 wt %, Mg was 0.01 wt % and Zn was 0.01 wt %.

The aluminum plate was surface grained in the same manner as in Example 1.

(1) Polishing

Using three rollers each having a diameter of 300 mm and constructed by a nylon non-woven fabric having attached thereto an abrasive, the polishing was performed while rotating the rollers at 1,000 rpm. During the polishing, water was sprayed between the aluminum plate and the nylon non-woven fabric roller.

(2) Etching in Aqueous Alkali Solution

The aluminum plate was etched by immersing it in an aqueous solution containing 27 wt % of NaOH and 6.5 wt % of aluminum ion at 70° C. The amount of the aluminum plate dissolved was 3 g/m$^2$. Thereafter, the aluminum plate was washed with water.

(3) Preliminary Electrochemical Surface Graining in Aqueous Hydrochloric Acid Solution Using the AC voltage of FIG. 1 and the apparatus of FIG. 2, continuous electrochemical surface graining was performed. At this time, the electrolytic solution was an aqueous solution containing 1 wt % of hydrochloric acid (containing 0.5 wt % of aluminum ion) and the liquid temperature was 35° C. In this electrochemical surface graining, the AC power waveform used was a trapezoidal rectangular wave AC of 60 Hz such that the time TP until the current value starting from zero reached the peak was 1 msec and the duty ratio was 1:1, and a carbon electrode was used as the counter electrode. The auxiliary anode used was ferrite.

The current density was 50 A/dm$^2$ in terms of the current peak value and the quantity of electricity was 40 C/dm$^2$ in terms of the total electricity quantity when the aluminum plate was at the anode time. Into the auxiliary anode, 5% of the current flowing from the power source was split. Thereafter, the aluminum plate was washed with water by a spray.

(4) Etching in Aqueous Alkali Solution

The aluminum plate was etched by immersing it in an aqueous solution containing 27 wt % of NaOH and 6.5 wt % of aluminum ion at 70° C. The amount of the aluminum plate dissolved was 0.3 g/m$^2$. Thereafter, the aluminum plate was washed with water.

(5) Desmutting

Then, the aluminum plate was desmutted by immersing it in an aqueous solution containing 1 wt % of nitric acid (containing 0.5 wt % of aluminum ion and 0.007 wt % of ammonium ion) at 35° C. for 10 seconds. Thereafter, the aluminum plate was washed with water.

(6) Desmutting

Then, the aluminum plate was desmutted by immersing it in an aqueous solution containing 1 wt % of nitric acid at 35° C. for 10 seconds. Thereafter, the aluminum plate was washed with water.

(7) Electrochemical Surface Graining in Aqueous Nitric Acid Solution

Using the AC voltage of FIG. 1 and two baths of the apparatus of FIG. 2, continuous electrochemical surface graining was performed. At this time, the electrolytic solution was an aqueous solution containing 1 wt % of nitric acid (containing 0.5 wt % of aluminum ion and 0.007 wt % of ammonium ion) and the liquid temperature was 50° C. In this electrochemical surface graining, the AC power waveform used was a trapezoidal rectangular wave AC of 60 Hz such that the time TP until the current value starting from zero reached the peak was 1 msec and the duty ratio was 1:1, and a carbon electrode was used as the counter electrode. The auxiliary anode used was ferrite. The current density was 50 A/dm$^2$ in terms of the current peak value and the quantity of electricity was 250 C/dm$^2$ in terms of the total electricity quantity when the aluminum plate was at the anode time. Into the auxiliary anode, 5% of the current flowing from the power source was split. Thereafter, the aluminum plate was water washed by a spray.

(8) Etching in Aqueous Alkali Solution

The aluminum plate was etched by immersing it in an aqueous solution containing 26 wt % of NaOH and 6.5 wt % of aluminum ion at 45° C. The amount of the aluminum plate dissolved was 0.5 g/m2. Thereafter, the aluminum plate was washed with water.

(9) Desmutting

The aluminum plate was washed with water and then desmutted by immersing it in an aqueous solution containing 25 wt % of sulfuric acid at 60° C. Thereafter, the aluminum plate was washed with water.

(10) Polishing

Using three rollers each having a diameter of 300 mm and constructed by a nylon non-woven fabric, the polishing was performed while rotating the rollers at 1,000 rpm. During the polishing, water was sprayed between the aluminum plate and the nylon non-woven fabric roller.

(11) Anodization

Anodization was performed in an aqueous solution having a sulfuric acid concentration of 15 wt % (containing 0.5 wt % of aluminum ion) at a liquid temperature of 35° C. using a DC voltage at a current density of 2 A/dm$^2$ such that the amount of the anodic oxide film formed was 2.4 g/m$^2$. Thereafter, the aluminum plate was water washed by a spray.

On the surface of the aluminum plate obtained, no appearance of streaks and grainy unevenness ascribable to the orientation of the crystal grain was shown.

On the aluminum plate, an interlayer and a photosensitive layer were coated and dried to prepare a positive PS plate having a dry thickness of 2.0 g/m$^2$. Printing was performed using this PS plate, as a result, the plate was verified to be a good printing plate.

This lithographic printing plate was used in a proof printing machine and then verified to be a good printing plate free of catching up of a sponge at the time when an operator supplied fountain solution by the sponge, and prevented from easy generation of sponge debris. Furthermore, because of no appearance of streaks and grainy unevenness, the aluminum plate surface was free of unevenness, therefore, the suitability for plate inspection was high.

Example 13

The substrate after anodization of Example 12 was hydrophilized by immersing it in an aqueous solution containing 25 wt % of sodium silicate at 70° C. for 14 seconds. Thereafter, the aluminum plate was washed with water and then dried. After each treatment and water washing, liquid squeezing by nip rollers was performed.

On the thus-treated aluminum plate, an interlayer and a negative photosensitive layer were coated and dried to prepare a PS plate. Printing was performed using this PS plate, as a result, the plate was verified to be a good printing plate.

Example 14

An aluminum plate according to JIS A 1050 having a thickness of 0.24 mm and a width of 1,030 mm, produced by a DC casting method where intermediate annealing and soaking were omitted, was chemically etched in an aqueous acid or alkali solution to be prone to appearance of streaks and grainy unevenness and then continuously treated.

This aluminum plate contained impurity trace components in such a proportion that Si was 0.06 wt %, Fe was 0.1%, Cu was 0.01 wt %, Ti was 0.02 wt %, Mn was 0.01 wt %, Mg was 0.01 wt % and Zn was 0.01 wt %.

The aluminum plate was surface grained in the same manner as in Example 1.

(1) Etching in Aqueous Alkali Solution

The aluminum plate was etched by immersing it in an aqueous solution containing 27 wt % of NaOH and 6.5 wt % of aluminum ion at 70° C. The amount of the aluminum plate dissolved was 5 g/m$^2$. Thereafter, the aluminum plate was washed with water.

(2) Desmutting

Next, the aluminum plate was desmutted by immersing it in an aqueous solution containing 1 wt % of hydrochloric acid at 35° C. for 10 seconds. Thereafter, the aluminum plate was washed with water.

(4) Preliminary Electrochemical Surface Graining in Aqueous Hydrochloric Acid Solution Using the AC voltage of FIG. 1 and one bath of the apparatus of FIG. 2, continuous electrochemical surface graining was performed. At this time, the electrolytic solution was an aqueous solution containing 1 wt % of hydrochloric acid (containing 0.5 wt % of aluminum ion) and the liquid temperature was 35° C. In this electrochemical surface graining, the AC power waveform used was a trapezoidal rectangular wave AC of 60 Hz such that the time TP until the current value starting from zero reached the peak was 1 msec and the duty ratio was 1:1, and a carbon electrode was used as the counter electrode. The auxiliary anode used was ferrite.

The current density was 50 A/dm$^2$ in terms of the current peak value and the quantity of electricity was 40 C/dm$^2$ in terms of the total electricity quantity when the aluminum plate was at the anode time. Into the auxiliary anode, 5% of the current flowing from the power source was split. Thereafter, the aluminum plate was washed with water by a spray.

(4) Etching in Aqueous Alkali Solution

The aluminum plate was etched by immersing it in an aqueous solution containing 27 wt % of NaOH and 6.5 wt % of aluminum ion at 70° C. The amount of the aluminum plate dissolved was 0.3 g/m$^2$. Thereafter, the aluminum plate was washed with water.

(5) Desmutting

Then, the aluminum plate was desmutted by immersing it in an aqueous solution containing 1 wt % of nitric acid at 35° C. for 10 seconds. Thereafter, the aluminum plate was washed with water.

(6) Electrochemical Surface Graining in Aqueous Nitric Acid Solution

Using the AC voltage of FIG. 1 and two baths of the apparatus of FIG. 2, continuous electrochemical surface graining was performed. At this time, the electrolytic solution was an aqueous solution containing 1 wt % of nitric acid (containing 0.5 wt % of aluminum ion) and the liquid temperature was 50° C. In this electrochemical surface graining, the AC power waveform used was a trapezoidal rectangular wave AC of 60 Hz such that the time TP until the current value starting from zero reached the peak was 1 msec and the duty ratio was 1:1, and a carbon electrode was used as the counter electrode. The auxiliary anode used was ferrite.

The current density was 50 A/dm$^2$ in terms of the current peak value and the quantity of electricity was 125 C/dm$^2$ in terms of the total electricity quantity when the aluminum plate was at the anode time. Into the auxiliary anode, 5% of the current flowing from the power source was split. Thereafter, the aluminum plate was water washed by a spray.

(7) Etching in Aqueous Alkali Solution

The aluminum plate was etched by immersing it in an aqueous solution containing 26 wt % of NaOH and 6.5 wt % of aluminum ion at 45° C. The amount of the aluminum plate dissolved was 0.1 g/m$^2$. Thereafter, the aluminum plate was washed with water.

(8) Desmutting

The aluminum plate was washed with water and then desmutted by immersing it in an aqueous solution containing 25 wt % of sulfuric acid at 60° C. Thereafter, the aluminum plate was washed with water.

(9) Polishing

Using three rollers each having a diameter of 300 mm and constructed by a nylon non-woven fabric of fine texture, the polishing was performed while rotating the rollers at 1,000 rpm. During the polishing, a 1 wt % of caustic soda (containing 0.1% of aluminum ion) at 30° C. was sprayed between the aluminum plate and the nylon non-woven fabric roller. At this time, the amount of aluminum dissolved was 0.1 g/m$^2$. Thereafter, the aluminum plate was washed with water and further desmutted in an aqueous solution containing 15 wt % of sulfuric acid (containing 0.5 wt % of aluminum ion).

(10) Anodization

Anodization was performed in an aqueous solution having a sulfuric acid concentration of 15 wt % (containing 0.5 wt % of aluminum ion) at a liquid temperature of 35° C. using a DC voltage at a current density of 2 A/dm$^2$ such that the amount of the anodic oxide film formed was 2.4 g/m$^2$. Thereafter, the aluminum plate was water washed by a spray.

On the surface of the aluminum plate obtained, no appearance of streaks and grainy unevenness ascribable to the orientation of the crystal grain was shown.

On the aluminum plate, an interlayer and a photosensitive layer were coated and dried to prepare a positive PS plate having a dry thickness of 2.0 g/m$^2$. Printing was performed using this PS plate, as a result, the plate was verified to be a good printing plate.

This lithographic printing plate was used in a proof printing machine and then verified to be a good printing plate free of catching up of a sponge at the time when an operator supplied fountain solution by the sponge, and prevented from easy generation of sponge debris. Furthermore, because of no appearance of streaks and grainy unevenness, the aluminum plate surface was free of unevenness, therefore, the suitability for plate inspection was high.

Scratches by mechanical polishing were not generated either.

Example 15

A surface graining treatment was performed thoroughly in the same manner as in Example 1 except that before the mechanical surface graining in Example 1, polishing was performed using three rollers each having a diameter of 300 mm and constructed by a nylon non-woven fabric having attached thereto an abrasive, while rotating the rollers at 1,000 rpm and during the polishing, water was sprayed between the aluminum plate and the nylon non-woven fabric roller.

The surface of the thus-treated aluminum plate was observed and found that scratches generated by the finish roller at the final cold rolling were not viewed. As a result, the yield of the product increased.

Example 16

A surface graining treatment was performed thoroughly in the same manner as in Example 3 or 4 except that before the alkali etching in (1) of Example 3 or (1) of Example 4, polishing was performed using three rollers each having a diameter of 300 mm and constructed by a nylon non-woven fabric having attached thereto an abrasive, while rotating the rollers at 1,000 rpm and during the polishing, water was sprayed between the aluminum plate and the nylon non-woven fabric roller.

The surface of each of the thus-treated aluminum plates was observed and found that scratches generated by the finish roller at the final cold rolling were not viewed. As a result, the yield of the product increased.

Example 17

In place of the chemical etching in an aqueous alkali solution in (8) of Example 1, (4) of Example 3 or (6) of Example 4, an electrolytic polishing was performed at 35° C. in an aqueous alkali solution containing 9 wt % of caustic soda, 0.5 wt % of aluminum and 250 g/l of polyethylene glycol, using the aluminum plate as the anode. A DC power source was used and the current density was 20 A/dm$^2$. The time of passing the current was controlled so that the amount of aluminum dissolved could be the same as in (8) of Example 1, (4) of Example 3 or (6) of Example 4. As a result, the streaks were more difficult to distinguish than in Example 1, 3 or 4. Moreover, a white aluminum support for a lithographic printing plate, having high suitability for plate inspection could be produced.

More specifically, aluminum plates according to JIS A 1050 having a thickness of 0.24 mm and a width of 1,030 mm, produced by a DC casting method where intermediate annealing and soaking were omitted, each was chemically etched in an aqueous acid or alkali solution to be prone to appearance of streaks and grainy unevenness and then continuously treated.

These aluminum plates each contained impurity trace components in such a proportion that Si was 0.15 wt %, Fe was 0.28%, Cu was 0.019 wt %, Ti was 0.03 wt %, Mn was 0.02 wt %, Mg was 0.023 wt % and Zn was 0.02 wt %.

(1) Mechanical Surface Graining

While supplying a suspension of quartz sand having a specific gravity of 1.12 and water as an abrasive slurry solution onto the surface of the aluminum plate, the mechanical surface graining was performed using rotating roller-form nylon brushes. The constructive material of the nylon brush used was 6·10 nylon, the hair length was 50 mm and the hair diameter was 0.48 mm. The nylon brush hairs were implanted densely into holes bored on a 300 mmϕ stainless steel-made tube. Three rotary brushes were used. The distance between two supporting rollers (ϕ200 mm) disposed at the lower part of brushes was 300 mm. The brush rollers were pressed until the load of a driving motor for rotating the brushes reached (the load before the pressing of brush rollers onto the aluminum plate)+6 kw. The rotating direction of brushes was the same as the moving direction of the aluminum plate. Thereafter, the aluminum plates were washed with water. The moving rate of the aluminum plate was 50 m/min.

(2) Etching in Aqueous Alkali Solution

The aluminum plates each was etched by immersing it in an aqueous solution containing 27 wt % of NaOH and 6.5 wt % of aluminum ion at 70° C. The amount of the aluminum plate dissolved was 10 g/m$^2$. Thereafter, the aluminum plates were washed with water.

(3) Desmutting

Next, the aluminum plates were desmutted by immersing them in an aqueous solution containing 1 wt % of hydrochloric acid at 35° C. for 10 seconds. Thereafter, the aluminum plates were washed with water.

(4) Preliminary Electrochemical Surface Graining in Aqueous Hydrochloric Acid Solution Using the AC voltage of FIG. 1 and one bath of the apparatus of FIG. 2, continuous electrochemical surface graining was performed. At this time, the electrolytic solution was an aqueous solution containing 1 wt % of hydrochloric acid (containing 0.5 wt % of aluminum ion) and the liquid temperature was 35° C. In this electrochemical surface graining, the AC power waveform used was a trapezoidal rectangular wave AC of 60 Hz such that the time TP until the current value starting from zero reached the peak was 1 msec and the duty ratio was 1:1, and a carbon electrode was used as the counter electrode. The auxiliary anode used was ferrite. The current density was 50 A/dm$^2$ in terms of the current peak value and the quantity of electricity was 40 C/dm$^2$ in terms of the total electricity quantity when the aluminum plate was at the anode time. Into the auxiliary anode, 5% of the current flowing from the power source was split. Thereafter, the aluminum plates were washed with water by a spray.

(5) Etching in Aqueous Alkali Solution

The aluminum plates each was etched by immersing it in an aqueous solution containing 27 wt % of NaOH and 6.5 wt % of aluminum ion at 70° C. The amount of the aluminum plate dissolved was 0.5 g/m$^2$ (Example 1-1), 1 g/m$^2$ (Example 1-2), 2 g/m$^2$ (Example 1-3) or 4 g/m$^2$ (Example 1-4). Thereafter, the aluminum plates were washed with water.

(6) Desmutting

Then, the aluminum plates each was desmutted by immersing it in an aqueous solution containing 1 wt % of nitric acid (containing 0.5 wt % of aluminum ion and 0.007 wt % of ammonium ion) at 35° C. for 10 seconds. Thereafter, the aluminum plates were washed with water.

(7) Electrochemical Surface Graining in Aqueous Nitric Acid Solution

Using the AC voltage of FIG. 1 and one bath of the apparatus of FIG. 2, continuous electrochemical surface graining was performed. At this time, the electrolytic solution was an aqueous solution containing 1 wt % of nitric acid (containing 0.5 wt % of aluminum ion and 0.007 wt % of ammonium ion) and the liquid temperature was 50° C. In this electrochemical surface graining, the AC power waveform used was a trapezoidal rectangular wave AC of 60 Hz such that the time TP until the current value starting from zero reached the peak was 1 msec and the duty ratio was 1:1, and a carbon electrode was used as the counter electrode. The auxiliary anode used was ferrite.

The current density was 50 A/dm$^2$ in terms of the current peak value and the quantity of electricity was 120 C/dm$^2$ in terms of the total electricity quantity when the aluminum plate was at the anode time. Into the auxiliary anode, 5% of the current flowing from the power source was split. Thereafter, the aluminum plates were water washed by a spray.

(8) Etching in Aqueous Alkali Solution

The aluminum plates each was etched by immersing it in an aqueous solution containing 27 wt % of NaOH and 6.5 wt % of aluminum ion at 70° C. The amount of the aluminum plate dissolved was 0.7 g/m$^2$. Thereafter, the aluminum plates were washed with water.

(9) Desmutting

The aluminum plates each was washed with water and then desmutted by immersing it in an aqueous solution containing 25 wt % of sulfuric acid at 60° C. Thereafter, the aluminum plates were washed with water.

(10) Polishing

Figure 3:
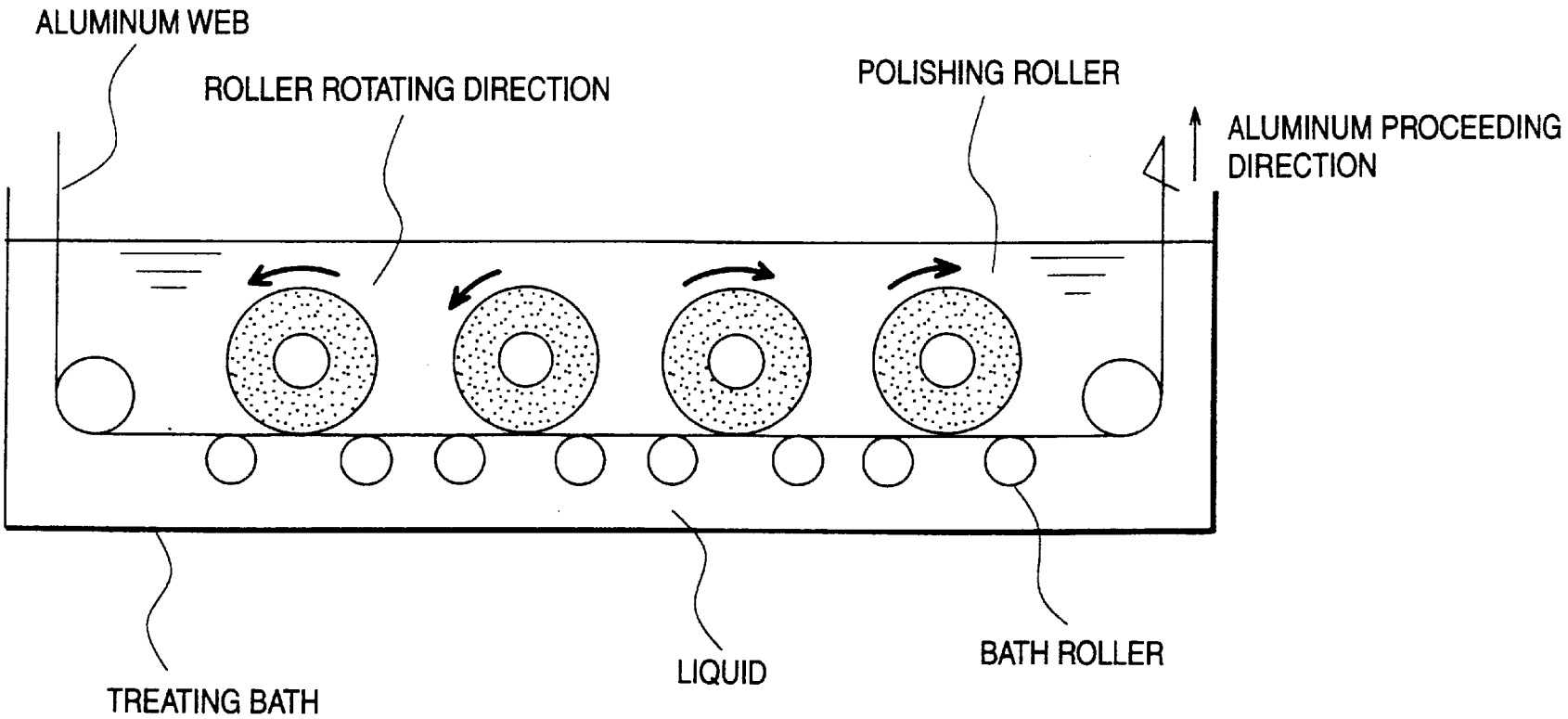
FIG. 3 is a side sectional view showing one example of the polishing apparatus for use in the present invention.

Using four rollers each having a diameter of 300 mm and constructed by a nylon non-woven fabric of fine texture, the polishing was performed while rotating the rollers at 200 rpm. The apparatus shown in FIG. 3 was used, where the aluminum plate and the nylon non-woven fabric rollers were immersed in the solution. The liquid temperature was 35° C. The solution was adjusted to have a viscosity of 20 cp by adding 0.02 wt % of a polymer coagulant PA-362 produced by Kurita Kogyo KK to well water.

(11) Anodization

Anodization was performed in an aqueous solution having a sulfuric acid concentration of 15 wt % (containing 0.5 wt % of aluminum ion) at a liquid temperature of 35° C. using a DC voltage at a current density of 2 A/dm$^2$ such that the amount of the anodic oxide film formed was 2.4 g/m$^2$. Thereafter, the aluminum plates were water washed by a spray.

On the surface of each aluminum plate obtained, no appearance of streaks and grainy unevenness ascribable to the orientation of the crystal grain was shown.

On each of the aluminum plates, an interlayer and a photosensitive layer were coated and dried to prepare a positive PS plate having a dry thickness of 2.0 g/m$^2$. Printing was performed using these PS plates, as a result, the plates were verified to be a good printing plate.

These lithographic printing plates each was used in a proof printing machine and then verified to be a good printing plate free of catching up of a sponge at the time when an operator supplied fountain solution by the sponge, and prevented from easy generation of sponge debris. Furthermore, because of no appearance of streaks and grainy unevenness, the aluminum plate surface was free of unevenness, therefore, the suitability for plate inspection was high.

Example 18

Figure 4:
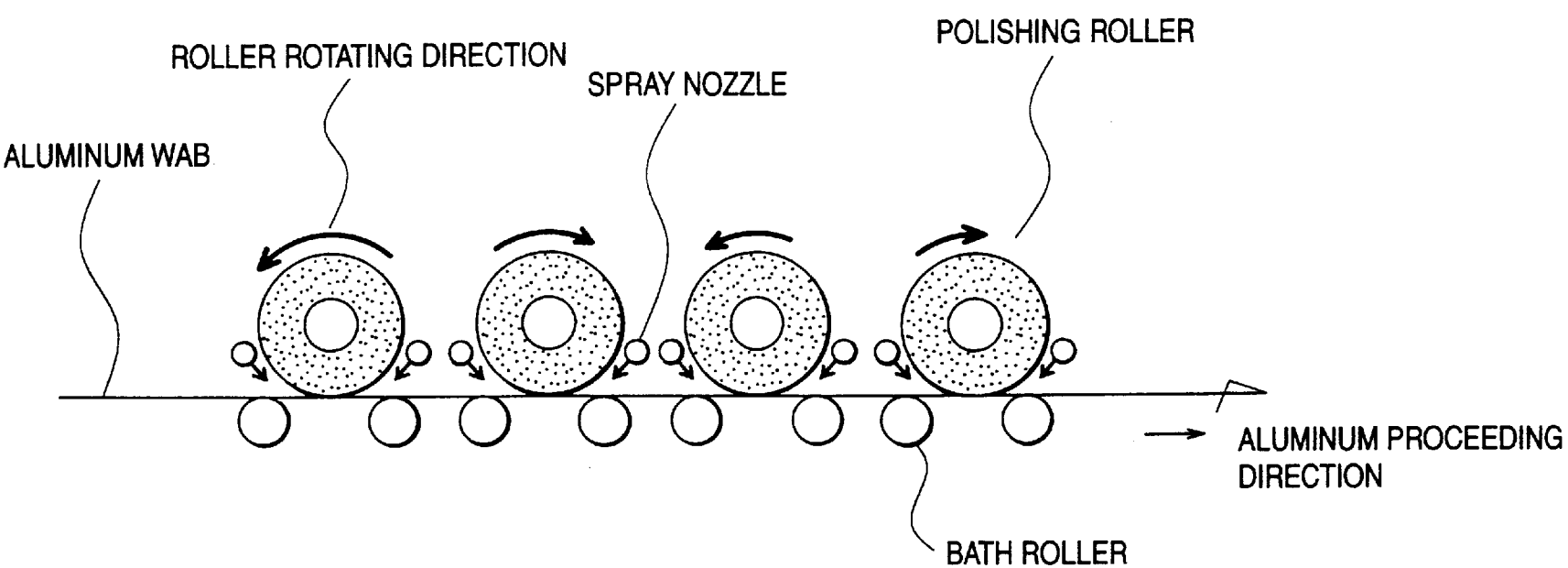
FIG. 4 is a side sectional view showing another example of the polishing apparatus for use in the present invention.

A polishing treatment was performed thoroughly in the same manner as in Example 10 except for using the apparatus shown in FIG. 4 for the polishing in (10) of Example 10.

On the thus-treated aluminum plate, an interlayer and a photosensitive layer were coated and dried to prepare a positive PS plate having a dry thickness of 2.0 g/m$^2$. Printing was performed using this PS plate, as a result, the plate was verified to be a good printing plate.

This lithographic printing plate was used in a proof printing machine and then verified to be a good printing plate free of catching up of a sponge at the time when an operator supplied fountain solution by the sponge, and prevented from easy generation of sponge debris. Furthermore, because of no appearance of streaks and grainy unevenness, the aluminum plate surface was free of unevenness, therefore, the suitability for plate inspection was high.

The surface of this aluminum plate was measured by AFM.

The atomic force microscope (AFM) used for the measurement in this Example was SP13700 manufactured by Seiko Denshi Kogyo KK. The measurement was performed in such a manner that an aluminum plate sample cut into a size of 1-cm square was set on a horizontal sample plate above a piezo-scanner, a cantilever was moved close to the sample surface and when it reached the region where atomic force acts, scanning in the XY direction was made. At this time, irregularities of the sample were apprehended by the piezo-displacement in the Z direction. The piezo-scanner used could scan 150 $\mu$m of XY and 10 $\mu$m of Z. The cantilever was a Si cantilever SI-DF20 manufactured by NANOPROBE having a resonance frequency of from 120 to 150 kHz and a spring constant of from 12 to 20 M/m, and a DMF mode (Dynamic Force Mode) thereof was used for the measurement. The three-dimensional data obtained were approximated to the least squares to thereby correct the slight inclination of the sample, and then the standard plane was determined.

In the measurement of large wave corrugation, average surface roughness and inclination degree, four visual fields of 50 $\mu$m-square measurement regions, namely, a 100-$\mu$m square was measured. The resolution in the XY direction was 0.1 $\mu$m, the resolution in the Z direction was 1 nm, and the scan speed was 25 $\mu$m/sec. The pitch of large wave corrugation was calculated by the frequency analysis of the three-dimensional date. The average roughness is a three-dimensionally extended value of the center line average height Ra defined in JIS B060. The surface inclination degree was measured in such a manner that three adjacent points were extracted from the three-dimensional data, the angle formed by the small triangle defined by the three points and the standard plate was calculated on all data to obtain a inclination degree distribution curve, and the proportion (%) of inclination degrees of 45° or more was determined. The specific surface area $\Delta S$ was the increase in percentage of S2 calculated from the surface area S1 of a flat face and the surface area S2 on the grained surface.

The surface of the aluminum plate obtained above was measured by AMF, as a result, it was found that Ra was 0.48 $\mu$m, a45 was 13% and $\Delta S$ was 19.8.

Comparative Example 1

An aluminum plate was surface grained thoroughly in the same manner as in Example 10 except that the polishing of Example 10 was omitted. The thus-treated aluminum plate was liable to catch the sponge for supplying the fountain solution and was readily soiled as compared with the aluminum plate of Example 10. The surface of this aluminum plate was measured by AFM, as a result, it was found that Ra was 0.48 $\mu$m, a45 was 15% and $\Delta S$ was 21%

According to the present invention, a stable and low-cost production method of an aluminum support almost prevented from generation of treatment unevenness called streaks or grainy unevenness ascribable to the difference in the aluminum dissolving rate due to the difference in the orientation of crystal grains is provided. The printing plate using the aluminum support of the present invention exhibits excellent printing durability and high performance against scumming on use in a usual printing machine and also exhibits disinclination for catching up of a sponge when fountain solution is supplied by the sponge on use in a printing machine for proof printing.

Furthermore, according to the present invention, the aluminum plate is polished while etching it in an aqueous acid or alkali solution, therefore, scratches are difficultly generated during the polishing.

Example 19

Figure 5:
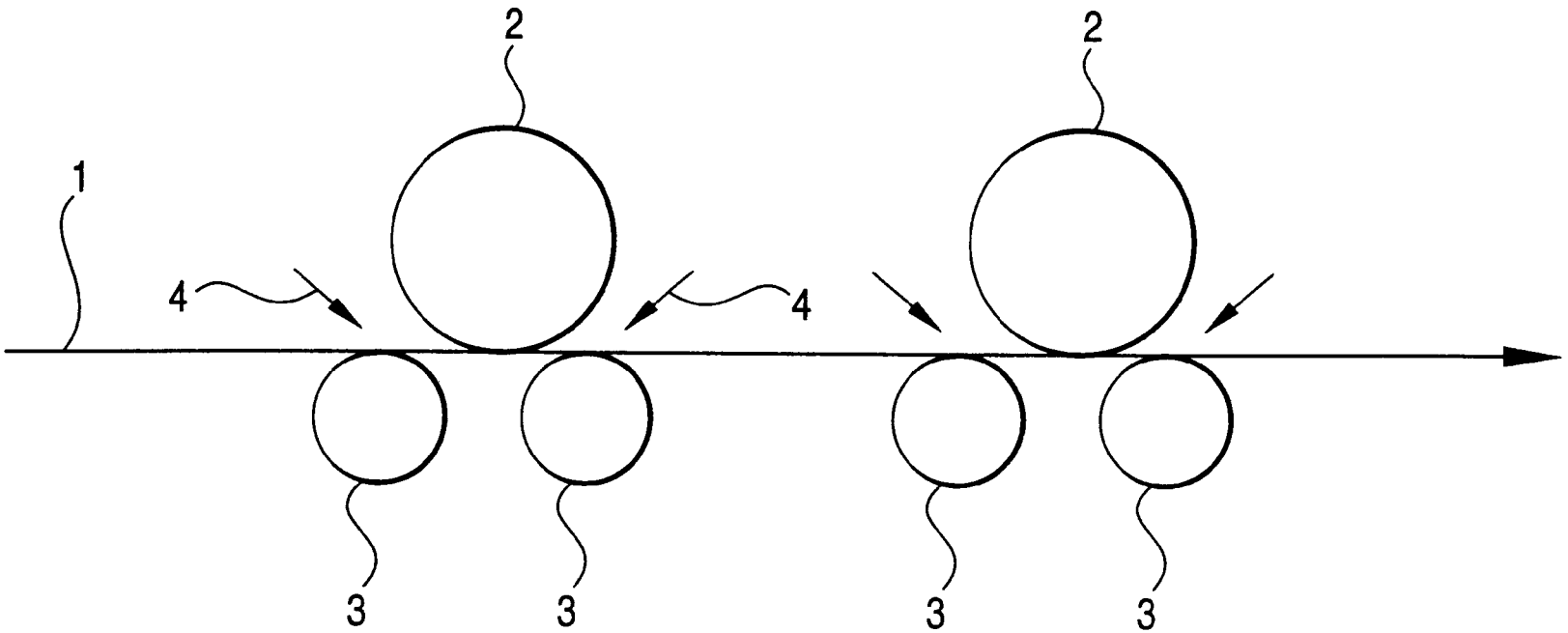
FIG. 5 is a side view showing the state of a roller shaving tips of projections on a surface grained aluminum plate.

An aluminum plate according to JIS1050 was mechanically grained using an apparatus described in JP-B-50-40047 at a revolution number of 250 rpm. The average surface roughness measured was 0.50 $\mu$m. As shown in FIG. 5, the thus-grained aluminum plate 1 was passed between backup rollers 3, 3 and a polishing roller 2 to shave off tips of the projections on the surface of the aluminum plate 1. The polishing roller 2 was constructed by 6-nylon fibers having an average diameter of 350 $\mu$m and an acryl binder and formed into a roll form having a hardness of 55°. This polishing roller 2 was rotated at a peripheral speed of 1,000 rpm once in the direction of the aluminum plate 1 proceeding and once in the direction reversed thereto. Thereafter, the aluminum plate was washed with water by means of a spray 4 and then subjected to an oxide film formation treatment with 150 g/l of sulfuric acid at a liquid temperature of 45° C. to have an amount of anodic oxide film of 2.6 g/m$^2$.

Example 20

An aluminum plate according to JIS1050 was mechanically grained using an apparatus described in JP-B-50-40047 at a revolution number of 250 rpm. The average surface roughness measured was 0.50 $\mu$m. The thus-grained aluminum plate was passed through an apparatus shown in FIG. 5 and a roller constructed by 6-nylon fibers having an average diameter of 350 $\mu$m and an acryl binder and formed in-to a roll form having a hardness of 45° was rotated at a peripheral speed of 1,000 rpm once in the direction of the aluminum plate proceeding and once in the direction reversed thereto. Thereafter, the aluminum plate was etched at a constant caustic soda concentration of 25% while controlling the time to have an etching amount of 8 g/m$^2$. Subsequently, the aluminum plate was washed with water and then subjected to an oxide film formation treatment with 150 g/l of sulfuric acid at a liquid temperature of 45° C. to have an amount of anodic oxide film of 2.6 g/m$^2$.

Example 21

An aluminum plate according to JIS1050 was mechanically grained using an apparatus described in JP-B-50-40047 at a revolution number of 250 rpm. The average surface roughness measured was 0.50 μm. Thereafter, the aluminum plate was etched at a constant caustic soda concentration of 25% while controlling the time to have an etching amount of 8 g/m$^2$. The thus-grained aluminum plate was passed through an apparatus shown in FIG. 5 and a roller constructed by 6-nylon fibers having an average diameter of 150 μm and an acryl binder and formed into a roll form having a hardness of 35° was rotated at a peripheral speed of 1,000 rpm once in the direction of the aluminum plate proceeding and once in the direction reversed thereto. Subsequently, the aluminum plate was washed with water and then subjected to an oxide film formation treatment with 150 g/l of sulfuric acid at a liquid temperature of 45° C. to have an amount of anodic oxide film of 2.6 g/m$^2$.

Example 22

An aluminum plate according to JIS1050 was mechanically grained using an apparatus described in JP-B-50-40047 at a revolution number of 250 rpm. The average surface roughness measured was 0.50 μm. Thereafter, the aluminum plate was etched at a constant caustic soda concentration of 25% while controlling the time to have an etching amount of 8 g/m$^2$. Then, the aluminum plate was washed with water, treated with a 20% sulfuric acid solution at 60° C. to remove smut (desmutting), and surface grained by a waveform described in JP-A-3-79399 at a frequency of 60 Hz in a nitric acid concentration of 12 g/l and an aluminum concentration of 5 g/l such that the quantity of anodic electricity was 300 c/dm$^2$. Subsequently, the aluminum plate was washed with water and then etched at a constant caustic soda concentration of 25% while controlling the time that the etching amount was 1 g/m$^2$. The thus-grained aluminum plate was passed through an apparatus shown in FIG. 5 and a roller constructed by 6-nylon fibers having an average diameter of 80 μm and an acryl binder and formed into a roll form having a hardness of 25° was rotated at a peripheral speed of 1,000 rpm once in the direction of the aluminum plate proceeding and once in the direction reversed thereto. Thereafter, the aluminum plate was washed with water and then subjected to an oxide film formation treatment with 150 g/l of sulfuric acid at a liquid temperature of 45° C. to have an amount of anodic oxide film of 2.6 g/m$^2$.

Example 23

An aluminum plate according to JIS1050 was etched at a constant caustic soda concentration of 25% while controlling the time to have an etching amount of 8 g/m$^2$. Then, the aluminum plate was washed with water, treated with a 20% sulfuric acid solution at 60° C. to remove smut (desmutting), and surface grained by a waveform described in JP-A-3-79399 at a frequency of 60 Hz in a nitric acid concentration of 12 g/l and an aluminum concentration of 5 g/l such that the quantity of anodic electricity was 300 c/dm$^2$. Subsequently, the aluminum plate was washed with water and then etched at a constant caustic soda concentration of 25% while controlling the time that the etching amount was 0.5 g/m$^2$. The thus-grained aluminum plate was passed through an apparatus shown in FIG. 5 and a roller constructed by 6-nylon fibers having an average diameter of 40 μm and an acryl binder and formed into a roll form having a hardness of 25° was rotated at a peripheral speed of 1,000 rpm once in the direction of the aluminum plate proceeding and once in the direction reversed thereto. Thereafter, the aluminum plate was washed with water and then subjected to an oxide film formation treatment with 150 g/l of sulfuric acid at a liquid temperature of 45° C. to have an amount of anodic oxide film of 2.6 g/m$^2$.

Example 24

An aluminum plate according to JIS1050 was mechanically grained using an apparatus described in JP-B-50-40047 at a revolution number of 250 rpm. The average surface roughness measured was 0.50 μm. Thereafter, the aluminum plate was etched at a constant caustic soda concentration of 25% while controlling the time to have an etching amount of 8 g/m$^2$. Then, the aluminum plate was washed with water, treated with a 20% sulfuric acid solution at 60° C. to remove smut (desmutting), and surface grained by a waveform described in JP-A-3-79399 at a frequency of 60 Hz in a nitric acid concentration of 12 g/l and an aluminum concentration of 5 g/l such that the quantity of anodic electricity was 300 c/dm$^2$. The thus-grained aluminum plate was passed through an apparatus shown in FIG. 5 and a roller constructed by 6-nylon fibers having an average diameter of 8 μm and an acryl binder and formed into a roll form having a hardness of 25° was rotated at a peripheral speed of 1,500 rpm once in the direction of the aluminum plate proceeding and once in the direction reversed thereto. Thereafter, the aluminum plate was washed with water, etched at a constant caustic soda concentration of 25% while controlling the time to have an etching amount of 0.5 g/m$^2$, again washed with water, and then subjected to an oxide film formation treatment with 150 g/l of sulfuric acid at a liquid temperature of 45° C. to have an amount of anodic oxide film of 2.6 g/m$^2$.

Comparative Example 2

An aluminum plate according to JIS1050 was mechanically grained using an apparatus described in JP-B-50-40047 at a revolution number of 250 rpm. The average surface roughness measured was 0.50 μm. Thereafter, the aluminum plate was washed with water and then subjected to an oxide film formation treatment with 150 g/l of sulfuric acid at a liquid temperature of 45° C. to have an amount of anodic oxide film of 2.6 g/m$^2$.

Comparative Example 3

An aluminum plate according to JIS1050 was mechanically grained using an apparatus described in JP-B-50-40047 at a revolution number of 250 rpm. The average surface roughness measured was 0.50 μm. Thereafter, the aluminum plate was etched at a constant caustic soda concentration of 25% while controlling the time to have an etching amount of 8 g/m$^2$. Subsequently, the aluminum plate was washed with water and then subjected to an oxide film formation treatment with 150 g/l of sulfuric acid at a liquid temperature of 45° C. to have an amount of anodic oxide film of 2.6 g/m$^2$.

Comparative Example 4

An aluminum plate according to JIS1050 was mechanically grained using an apparatus described in JP-B-50-40047 at a revolution number of 560 rpm. The average surface roughness measured was 0.50 μm. Thereafter, the aluminum plate was etched at a constant caustic soda concentration of 25% while controlling the time to have an etching amount of 8 g/m$^2$. Then, the aluminum plate was washed with water, treated with a 20% sulfuric acid solution at 60° C. to remove smut (desmutting), and surface grained by a waveform described in JP-A-3-79399 at a frequency of 60 Hz in a nitric acid concentration of 12 g/l and an aluminum concentration of 5 g/l such that the quantity of anodic electricity was 300 c/dm$^2$. Subsequently, the aluminum plate was washed with water, etched at a constant caustic soda concentration of 25% while controlling the time to have an etching amount of 0.5 g/m$^2$, again washed with water, and then subjected to an oxide film formation treatment with 150 g/l of sulfuric acid at a liquid temperature of 45° C. to have an amount of anodic oxide film of 2.6 g/m$^2$.

On each of the supports manufactured in Examples 19 to 24 and Comparative Examples 2 to 4, a photosensitive layer was coated. The lithographic printing plates obtained were examined on the printing performance and assuming that the plate is used for proof printing, the catching up of sponge was examined. As a result, in the case of supports of Examples 19 to 24, no trouble was generated with respect to both the printing performance and the catching up of sponge. However, in the case of supports of Comparative Examples 2 to 4, the printing performance, particularly, the disinclination for summing was greatly deteriorated and the sponge was readily caught up, revealing that the workability was very poor.

As described in the foregoing, according to the production method of a support for a lithographic printing plate of the present invention, the surface of a support for a lithographic printing plate is surface grained or etched by mechanical surface graining, chemical etching or electrochemical surface graining and then subjected to a treatment where the tips of projections on the surface of the support for a lithographic printing plate by filiform fibers having a diameter of from 5 to 600 $\mu$m. Therefore, a high-quality support for a lithographic printing plate, free of local unevenness can be produced.

What is claimed is:

1. A method for producing an aluminum support for a lithographic printing plate, comprising subjecting an aluminum plate to surface graining and then to mechanical polishing, wherein the surface graining is electrochemical surface graining using a direct or alternating current in an aqueous nitric acid solution, the aluminum plate being subjected to a preliminary surface graining treatment for generating fine irregularities before the electrochemical surface graining, and wherein the preliminary surface graining treatment comprises:

(i) preliminary electrochemical surface graining of from 1 to 300 C/dm$^2$ using an alternating current in an aqueous solution mainly comprising hydrochloric acid, and (ii) chemical etching of from 0.1 to 1.0 g/m$^2$ in an aqueous alkali solution.

2. The method for producing an aluminum support for a lithographic printing plate as claimed in claim 1, wherein the mechanical polishing is performed using nylon brush, rubber, cloth, non-woven fabric, nylon non-woven fabric, sponge, felt, leather or burnishing cloth while spraying water or spraying a solution for chemically etching the aluminum, or in water or in a solution for chemically etching the aluminum.

3. The method for producing an aluminum support for a lithographic printing plate as claimed in claim 1, wherein the mechanical polishing is performed while using an abrasive.

4. The method for producing an aluminum support for a lithographic printing plate as claimed in claim 1, wherein the aluminum plate is subjected to anodization and then hydrophilized.

5. The method for producing an aluminum support for a lithographic printing plate as claimed in claim 1, wherein the aluminum plate is produced by a DC casting method where intermediate annealing or soaking is omitted or intermediate annealing and soaking are omitted or by a continuous casting method where intermediate annealing is omitted, and the aluminum alloy contains hetero-elements in such a proportion that Si is from 0.03 to 1.0 wt %, Fe is from 0.05 to 1.0 wt %, Cu is from 0.001 to 0.2 wt %, Ti is from 0.01 to 0.1 wt %, Mn is from 0 to 1.5 wt %, Mg is from 0.0 to 0.3 wt %, and Zn is from 0 to 0.1 wt %.

6. The method for producing an aluminum support for a lithographic printing plate as claimed in claim 1, wherein the aluminum plate is previously subjected to buff polishing.

7. The method for producing an aluminum support for a lithographic printing plate as claimed in claim 1, further comprising at least one step of polishing the aluminum plate while spraying an acid or alkali etching solution or dissolving the aluminum plate in an acid or alkali etching solution.

8. The method for producing an aluminum support for a lithographic printing plate as claimed in claim 1, wherein the mechanical polishing is performed while spraying a solution having a viscosity of from 1 to 200 cp onto the surface of the aluminum plate or while immersing the aluminum plate in a solution having a viscosity of from 1 to 200 cp.

9. A method for producing an aluminum support for a lithographic printing plate, comprising subjecting an aluminum plate to surface graining and then to mechanical polishing, wherein chemical etching is performed before or after the mechanical polishing or before and after the mechanical polishing.

10. A method for producing an aluminum support for a lithographic printing plate, comprising subjecting an aluminum plate to surface graining and then to mechanical polishing, wherein the surface graining is electrolytic polishing and chemical etching is performed before or after the electrolytic polishing or before and after the electrolytic polishing.

11. The method for producing an aluminum support for a lithographic printing plate as claimed in claim 10, wherein an electrolytic solution is used for the electrolytic polishing, and the electrolytic solution contains a polymer compound as a thickener.

12. The method for producing an aluminum support for a lithographic printing plate as claimed in claim 10, wherein an electrolytic solution is used for the electrolytic polishing, and the electrolytic solution has a viscosity of from 1 to 200 cP.

13. A method for producing an aluminum support for a lithographic printing plate, comprising subjecting an aluminum plate to surface graining and then to mechanical polishing, wherein the surface graining is chemical etching and the aluminum plate is desmutted in an acidic aqueous solution after the chemical etching.

14. A method for producing an aluminum support for a lithographic printing plate, comprising subjecting an aluminum plate to surface graining and then to mechanical polishing, wherein the surface graining is at least one of mechanical surface graining, electrolytic polishing, and chemical etching, the aluminum plate being subjected to a preliminary surface graining treatment for generating fine irregularities before the at least one of mechanical surface graining, electrolytic polishing, and chemical etching, and wherein the preliminary surface graining treatment comprises:

(i) preliminary electrochemical surface graining of from 1 to 300 C/dm$^2$ using an alternating current in an aqueous solution mainly comprising hydrochloric acid, and (ii) chemical etching of from 0.1 to 1.0 g/m$^2$ in an aqueous alkali solution.

15. The method for producing an aluminum support for a lithographic printing plate as claimed in claim 14, wherein the mechanical polishing is performed using nylon brush, rubber, cloth, non-woven fabric, nylon non-woven fabric, sponge, felt, leather or burnishing cloth while spraying water or spraying a solution for chemically etching the aluminum, or in water or in a solution for chemically etching the aluminum.

16. The method for producing an aluminum support for a lithographic printing plate as claimed in claim 14, wherein the mechanical polishing is performed while using an abrasive.

17. The method for producing an aluminum support for a lithographic printing plate as claimed in claim 14, wherein the aluminum plate is subjected to anodization and then hydrophilized.

18. The method for producing an aluminum support for a lithographic printing plate as claimed in claim 16, wherein the aluminum plate is produced by a DC casting method where intermediate annealing or soaking is omitted or intermediate annealing and soaking are omitted or by a continuous casting method where intermediate annealing is omitted, and the aluminum alloy contains hetero-elements in such a proportion that Si is from 0.03 to 1.0 wt %, Fe is from 0.05 to 1.0 wt %, Cu is from 0.001 to 0.2 wt %, Ti is from 0.01 to 0.1 wt %, Mn is from 0 to 1.5 wt %, Mg is from 0.0 to 0.3 wt %, and Zn is from 0 to 0.1 wt %.

19. The method for producing an aluminum support for a lithographic printing plate as claimed in claim 14, wherein the aluminum plate is previously subjected to buff polishing.

20. The method for producing an aluminum support for a lithographic printing plate as claimed in claim 14, further comprising at least one step of polishing the aluminum plate while spraying an acid or alkali etching solution or dissolving the aluminum plate in an acid or alkali etching solution.

21. The method for producing an aluminum support for a lithographic printing plate as claimed in claim 14, wherein the mechanical polishing is performed while spraying a solution having a viscosity of from 1 to 200 cp onto the surface of the aluminum plate or while immersing the aluminum plate in a solution having a viscosity of from 1 to 200 cp.

* * * * *